US011801696B2

(12) United States Patent
Izoe et al.

(10) Patent No.: US 11,801,696 B2
(45) Date of Patent: Oct. 31, 2023

(54) SHEET CONVEYOR AND IMAGE FORMING SYSTEM

(71) Applicant: BROTHER KOGYO KABUSHIKI KAISHA, Nagoya (JP)

(72) Inventors: Shintaro Izoe, Kiyosu (JP); Yuji Nishigaki, Nagoya (JP); Teruhito Hasegawa, Nagoya (JP); Yuri Morishita, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 392 days.

(21) Appl. No.: 17/121,963

(22) Filed: Dec. 15, 2020

(65) Prior Publication Data

US 2021/0178786 A1 Jun. 17, 2021

(30) Foreign Application Priority Data

Dec. 16, 2019 (JP) ..... 2019-226414
Mar. 6, 2020 (JP) ..... 2020-039178

(51) Int. Cl.
*B41J 15/04* (2006.01)
*B41J 15/02* (2006.01)
(Continued)

(52) U.S. Cl.
CPC ..... *B41J 15/048* (2013.01); *B41J 15/02* (2013.01); *B41J 15/165* (2013.01); *B65H 16/02* (2013.01);
(Continued)

(58) Field of Classification Search
CPC ..... B65H 16/02; B65H 16/10; B65H 16/103; B65H 16/106; B65H 20/00; B65H 20/005;
(Continued)

(56) References Cited

U.S. PATENT DOCUMENTS 4,159,808 A * 7/1979 Meihofer ..... B65H 23/1955 242/415.1
4,888,717 A * 12/1989 Ditto ..... B65H 39/16 226/3
(Continued)

FOREIGN PATENT DOCUMENTS

JP 2009-208921 A 9/2009
JP 2014-076669 A 5/2014
JP 2014-177318 A 9/2014

OTHER PUBLICATIONS

JP2014177318A Translation; Nagasaka et al; "Remaining Amount Derivation Device For Rolled Recording Medium, Supply Device For Rolled Recording Medium, And Remaining Amount Derivation Method And Program For Rolled Recording Medium"; Published: Sep. 25, 2014; Published By: Espacenet (Year: 2014).*
(Continued)

*Primary Examiner* — Michael R Mansen
*Assistant Examiner* — Raveen J Dias
(74) *Attorney, Agent, or Firm* — Scully, Scott, Murphy & Presser, PC

(57) ABSTRACT

A sheet conveyor includes: a holder that detachably holds a sheet roll; a rotation measuring device that measures a rotation amount of the sheet roll; a conveyance roller that conveys a sheet pulled out from the sheet roll held by the holder; a tensioner that is provided between the holder and the conveyance roller and that contacts with the sheet pulled out from the sheet roll toward the conveyance roller; a position detector that detects a position of the tensioner; a motor that generates driving force for rotating the conveyance roller; and a controller that controls the motor. The controller estimates a diameter of the sheet roll based on a conveyance amount of the sheet caused by rotation of the conveyance roller, a rotation amount of the sheet roll mea-
(Continued)

sured by the rotation measuring device, and a position of the tensioner detected by the position detector.

18 Claims, 14 Drawing Sheets

(51) Int. Cl.

| | |
|---|---|
| ***B65H 23/185*** | (2006.01) |
| ***B65H 16/02*** | (2006.01) |
| ***B65H 16/10*** | (2006.01) |
| ***B65H 23/192*** | (2006.01) |
| ***B65H 23/182*** | (2006.01) |
| ***B65H 23/00*** | (2006.01) |
| ***B65H 23/14*** | (2006.01) |
| ***B41J 15/16*** | (2006.01) |
| ***B65H 26/08*** | (2006.01) |

(52) U.S. Cl.
CPC ..... *B65H 16/103* (2013.01); *B65H 23/005* (2013.01); *B65H 23/14* (2013.01); *B65H 23/185* (2013.01); *B65H 23/1825* (2013.01); *B65H 23/192* (2013.01); *B65H 26/08* (2013.01); *B65H 2511/14* (2013.01)

(58) Field of Classification Search
CPC ..... B65H 20/02; B65H 20/04; B65H 23/00; B65H 23/005; B65H 23/025; B65H 23/044; B65H 23/048; B65H 23/10; B65H 23/105; B65H 23/14; B65H 23/16; B65H 23/182; B65H 23/1825; B65H 23/185; B65H 23/188; B65H 23/1882; B65H 23/1888; B65H 23/192; B65H 26/02; B65H 26/04; B65H 26/08; B65H 2511/14; B65H 2557/262; B41J 11/007; B41J 11/42; B41J 15/00; B41J 15/02; B41J 15/048; B41J 15/16; B41J 15/165
See application file for complete search history.

(56) References Cited

U.S. PATENT DOCUMENTS

| | | | | |
|---|---|---|---|---|
| 5,533,821 | A * | 7/1996 | Awai | B41J 15/042 400/621 |
| 5,717,836 | A * | 2/1998 | Horie | B41J 11/70 399/385 |
| 5,825,374 | A * | 10/1998 | Albertalli | B65H 20/24 242/412.2 |
| 5,941,473 | A * | 8/1999 | Kawano | B65H 23/198 242/413.1 |
| 6,168,108 | B1 * | 1/2001 | Morley | B65H 23/063 242/421.7 |
| 6,314,333 | B1 * | 11/2001 | Rajala | B65H 23/1825 318/7 |
| 6,439,786 | B1 * | 8/2002 | Hasiuk | B41J 23/025 400/614 |
| 6,856,850 | B2 * | 2/2005 | Rajala | B65H 23/1825 318/7 |
| 6,910,820 | B2 * | 6/2005 | Baker | B65B 51/067 400/613 |
| 7,036,923 | B2 * | 5/2006 | Takagi | B41J 15/048 400/621 |
| 7,220,071 | B2 * | 5/2007 | Baker | B41J 13/02 400/613 |
| 7,618,204 | B2 * | 11/2009 | Blanchard, Jr. | B65H 23/34 400/621 |
| 8,465,146 | B2 * | 6/2013 | Satoh | B65H 23/16 242/564 |
| 8,956,062 | B2 * | 2/2015 | Nakayama | B41J 15/042 400/613 |
| 9,550,646 | B2 * | 1/2017 | Horaguchi | B41J 15/165 |
| 10,086,631 | B2 * | 10/2018 | Takahashi | B65C 9/0015 |
| 10,246,288 | B2 * | 4/2019 | Minato | B65H 23/198 |
| 10,562,728 | B2 * | 2/2020 | Ota | B65H 23/188 |
| 2002/0059013 | A1 * | 5/2002 | Rajala | B65H 23/1825 700/122 |
| 2003/0052148 | A1 * | 3/2003 | Rajala | B65H 23/063 226/44 |
| 2005/0019081 | A1 * | 1/2005 | Baker | B65B 51/067 400/615.2 |
| 2005/0024464 | A1 * | 2/2005 | Takagi | B41J 15/04 347/104 |
| 2005/0186009 | A1 * | 8/2005 | Baker | B41J 15/165 400/619 |
| 2007/0248396 | A1 * | 10/2007 | Blanchard | B65H 23/34 400/621 |
| 2008/0197228 | A1 * | 8/2008 | Mueller | B65H 23/195 242/419.9 |
| 2009/0101747 | A1 * | 4/2009 | Doeres | B65H 19/10 242/534.2 |
| 2011/0170928 | A1 * | 7/2011 | Nakayama | B65H 23/08 242/564.4 |
| 2011/0211031 | A1 * | 9/2011 | Satoh | B65H 23/16 242/419 |
| 2011/0246127 | A1 * | 10/2011 | Schnabel | B65H 23/192 702/145 |
| 2014/0192108 | A1 * | 7/2014 | Horaguchi | B41J 11/007 347/16 |
| 2015/0007769 | A1 * | 1/2015 | Miura | H01M 4/0402 118/708 |
| 2015/0175374 | A1 * | 6/2015 | Horaguchi | B65H 23/1825 226/1 |
| 2016/0311638 | A1 * | 10/2016 | Minato | B65H 26/04 |
| 2016/0318321 | A1 * | 11/2016 | Takahashi | B65C 9/0015 |
| 2017/0253452 | A1 * | 9/2017 | Ota | B65H 23/1888 |
| 2017/0274688 | A1 * | 9/2017 | Hatada | B65H 20/30 |
| 2020/0262221 | A1 * | 8/2020 | Yokozawa | B41J 15/16 |
| 2020/0282749 | A1 * | 9/2020 | Imamura | B41J 2/2114 |
| 2020/0307278 | A1 * | 10/2020 | Yamada | B65H 23/1888 |
| 2021/0179380 | A1 * | 6/2021 | Hasegawa | B65H 23/185 |
| 2021/0237492 | A1 * | 8/2021 | Watari | G03G 15/6517 |
| 2021/0300091 | A1 * | 9/2021 | Yamaguchi | B41J 15/044 |
| 2022/0379629 | A1 * | 12/2022 | Kawajiri | B41J 15/042 |
| 2023/0043935 | A1 * | 2/2023 | Fujiwara | B41J 15/16 |

OTHER PUBLICATIONS

JP2014076669A Translation; Hatada et al; "Printing Method And Printing Apparatus"; Published: May 1, 2014; Published By: Espacenet (Year: 2014).*

* cited by examiner

SHEET CONVEYOR AND IMAGE FORMING SYSTEM

CROSS REFERENCE TO RELATED APPLICATION

The present application claims priority from Japanese Patent Applications No. 2019-226414 filed on Dec. 16, 2019 and No. 2020-039178 filed on Mar. 6, 2020, the disclosures of which are incorporated herein by reference in its entirety.

BACKGROUND

Field of the Invention

The present disclosure relates to a sheet conveyor and an image forming system.

Description of the Related Art

There is conventionally known a printing apparatus that pulls out a sheet from a sheet roll (rolled sheet) and prints an image on the pulled-out sheet (see, for example, Japanese Patent Application Laid-open No. 2014-076669). The sheet is pulled out toward a recording head by use of a conveyance roller.

In the printing apparatus, a diameter of the sheet roll is determined. The diameter of the sheet roll determined is used for controlling conveyance of the sheet. The diameter of the sheet roll is measured, for example, by a distance sensor. Or, the diameter of the sheet roll is estimated based on a conveyance amount of the sheet under a condition that the sheet is conveyed by the conveyance roller and a rotation amount of the sheet roll.

SUMMARY

A sheet conveyor that pulls out a sheet from a sheet roll and conveys the sheet may include a tensioner positioned between the sheet roll and a conveyance roller and configured to apply tension to the sheet.

The tensioner includes a movable part. The movable part comes into contact with the sheet to apply tension to the sheet. The movable part is displaced upon receiving urging force from an elastic material such as a spring to apply appropriate tension to the sheet.

In the conveyor including the above-described tensioner, a posture of the sheet pulled out from the sheet roll changes by the displacement of the tensioner. It is thus not possible to accurately estimate the diameter of the sheet roll in the above-described conventional method in which the diameter of the sheet roll is estimated based on the conveyance amount of the sheet by the conveyance roller and the rotation amount of the sheet roll.

An object of the present disclosure is to provide a sheet conveyor including a tensioner in which a diameter of a sheet roll can be accurately estimated based on a conveyance amount of a sheet or the like without actually measuring the diameter of the sheet roll by a sensor.

According to the first aspect of the present disclosure, there is provided a sheet conveyor, including: a holder; a rotation measuring device; a conveyance roller; a tensioner; a position detector; a motor; and controller. The holder is configured to detachably hold a sheet roll. The rotation measuring device is configured to measure a rotation amount of the sheet roll.

The conveyance roller is configured to convey the sheet pulled out from the sheet roll held by the holder. The tensioner is provided between the holder and the conveyance roller. The tensioner is movable and configured to contact with the sheet pulled out from the sheet roll toward the conveyance roller. The position detector is configured to detect a position of the tensioner.

The motor is configured to generate driving force for rotating the conveyance roller. The controller is configured to control the motor. The controller is configured to estimate a diameter of the sheet roll based on a conveyance amount of the sheet caused by rotation of the conveyance roller driven by the motor, the rotation amount of the sheet roll measured by the rotation measuring device, and the position of the tensioner detected by the position detector.

This sheet conveyor can estimate the diameter of the sheet roll with high accuracy based on the conveyance amount of the sheet by the conveyance roller and the rotation amount of the sheet roll, even under a condition that a posture of the sheet pulled out from the sheet roll changes depending on the position of the tensioner in a section ranging from the sheet roll to the conveyance roller. It is thus possible to estimate the diameter of the sheet roll with high accuracy without actually measuring the diameter of the sheet roll by a sensor.

According to the second aspect of the present disclosure, there is provided an image forming system including: the sheet conveyor as defined in the first aspect and a process unit. The process unit is provided downstream of the conveyance roller in a conveyance direction of the sheet and configured to form an image on the sheet.

DESCRIPTION OF THE EMBODIMENTS

First the Embodiment

Figure 1:
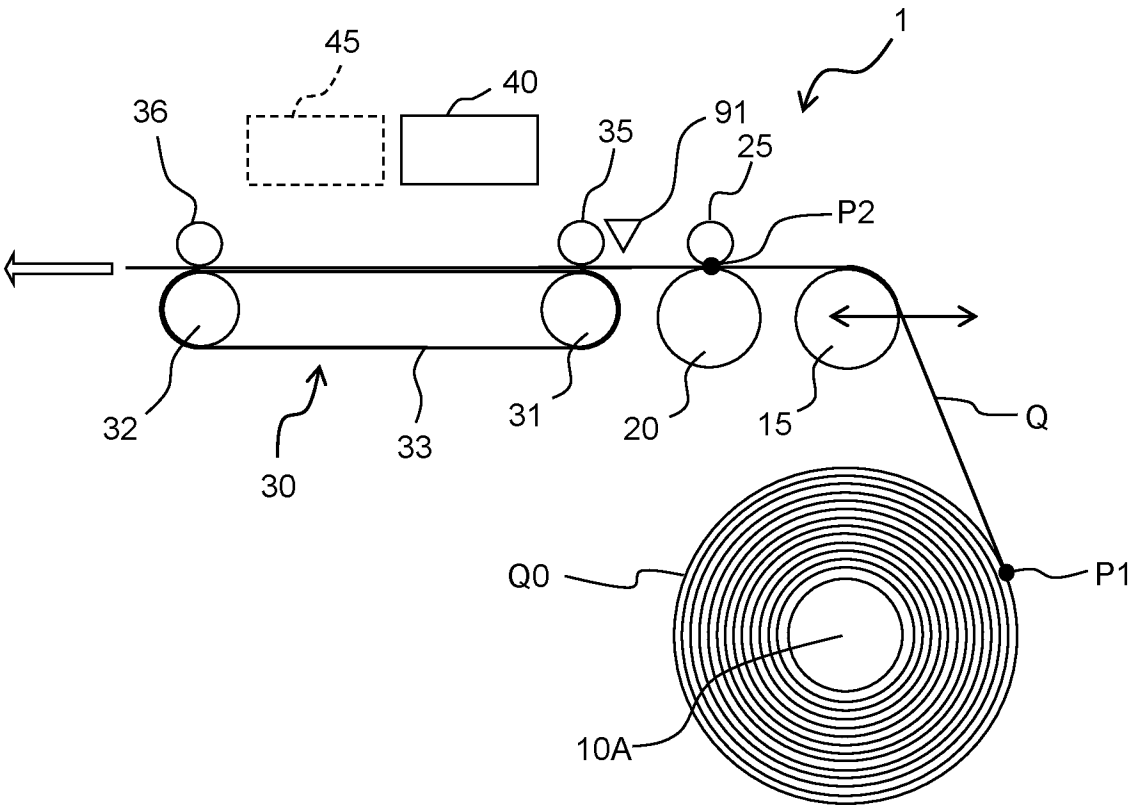
FIG. 1 depicts a configuration of an image forming system according to an aspect of the present disclosure.

A first embodiment of the present disclosure will be described with reference to the accompanying drawings. An image forming system 1 of this embodiment depicted in FIG. 1 is configured so as to form an image on a sheet Q pulled out from a sheet roll Q0 (rolled sheet). The image forming system 1 functions as a sheet conveying device for conveying the sheet Q toward the lower side of the recording head 40.

The image forming system 1 includes a holder 10 (see FIG. 3), a tensioner 15, a conveying roller 20, a nip roller 25, a belt mechanism 30, and a recording head 40. In FIG. 1, configuration downstream of the belt mechanism 30 in a conveyance direction of the seat Q is omitted. Downstream of the belt mechanism 30, for example, a cutter for cutting the sheet Q is provided.

The holder 10 removably holds the sheet roll Q0. The sheet roll Q0 is formed by the sheet Q wound around a hollow core material. The holder 10 includes a rotation shaft 10A inserted through the core material of the sheet roll Q0, and a holder main body (not depicted in the drawing(s)) that rotatably holds the rotation shaft 10A.

The holder main body is fixed in a casing (not depicted in the drawing(s)) of the image forming system 1. The core material of the sheet roll Q0 is fixed so as not to slide with respect to the rotation shaft 10A of the holder 10. As a result, the sheet roll Q0 rotates together with the rotation shaft 10A of the holder 10.

After the sheet roll Q0 is mounted on the rotating shaft 10A, the sheet Q is manually pulled out from the sheet roll Q0 via the tensioner 15 to a position where the sheet Q has passed through the nip point P2 between the conveying roller 20 and the nip roller 25. Point P1 in FIG. 1 indicates the point at which the sheet Q is pulled out of the sheet roll Q0.

Figure 2:
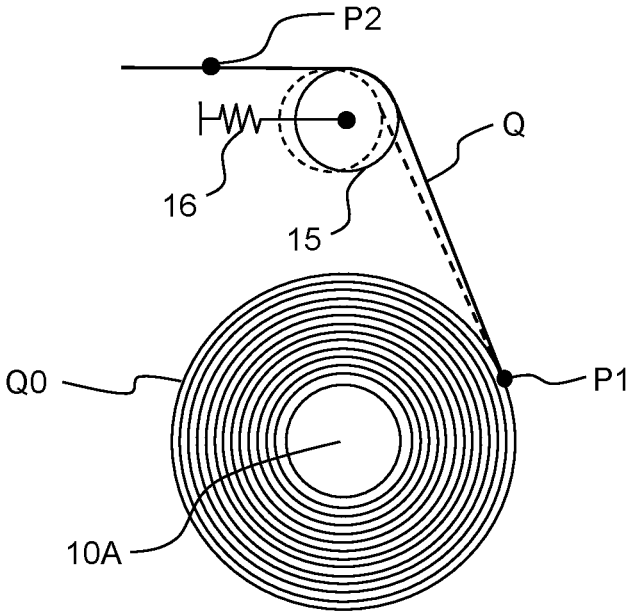
FIG. 2 illustrates functions of a tensioner.

The conveying roller 20 conveys the sheet Q nipped between the conveying roller 20 and the nip roller 25 in the conveyance direction indicated by the thick arrow. As depicted in FIG. 2, the tensioner 15 is connected to the spring member 16 to be displaceable in a front-rear direction. The front side corresponds to the downstream side of the conveyance direction and the rear side corresponds to the upstream side of the conveyance direction.

The tensioner 15 is disposed at the rear side of the spring material 16. The tensioner 15 applies tension to the sheet Q by backward urging force from the spring material 16.

The tensioner 15 is displaced frontward by receiving pressing force from the sheet Q under a condition that the sheet Q pulled out from the sheet roll Q0 is conveyed by the conveyance roller 20. The pressing force from the sheet Q corresponds to tension of the sheet Q. FIG. 2 depicts a state where the tensioner 15 and the sheet Q are displaced from a position depicted by solid lines to a position depicted by dotted lines due to the pressing force from the sheet Q.

A position in the front-rear direction of the tensioner 15 is stabilized at a position where the urging force of the spring material 16 and the tension of the sheet Q are balanced. The image forming system 1 is configured to estimate the tension of the sheet Q and control the tension by using the position of the tensioner 15 as an index (details are described below).

The belt mechanism 30 is disposed downstream of the conveyance roller 20 in the conveyance direction. The belt mechanism 30 conveys the sheet Q conveyed from the conveyance roller 20 further downstream. As depicted in FIG. 1, the belt mechanism 30 includes a driving roller 31, a driven roller 32, and a belt 33 stretched between the driving roller 31 the driven roller 32. The driving roller 31 rotates the belt 33 by rotary motion synchronized with the conveyance roller 20.

The belt mechanism 30 further includes the first facing roller 35 and the second facing roller 36. The first facing roller 35 faces the driving roller 31 with the belt 33 interposed therebetween. The second facing roller 36 faces the driven roller 32 with the belt 33 interposed therebetween.

The sheet Q conveyed from the conveyance roller 20 passes between the first facing roller 35 and the belt 33 due to the rotation of the belt 33, so that the sheet Q is conveyed downstream. The sheet Q is conveyed further downstream by passing between the second facing roller 36 and the belt 33. A conveyance velocity of the sheet Q by the rotation of the belt 33 is the same as a conveyance velocity of the sheet Q by use of the conveyance roller 20.

For example, the belt mechanism 30 can have an air absorbing function. That is, the belt 33 may have fine holes through which air passes. A suction device (not depicted) that suctions air may be provided below the belt 33. The sheet Q may be conveyed while being sucked or absorbed to a surface of the belt 33 by the air suction performed by the suction device.

The recording head 40 is provided above the belt mechanism 30 to form an image on the sheet Q passing below the recording head 40. The recording head 40, which is a line head, simultaneously forms images for an entirety in a line direction of the sheet Q passing below the recording head 40. The line direction is a direction along the surface of the sheet Q. The line direction is the conveyance direction of the sheet Q, in other words, a direction orthogonal to a longitudinal direction of the sheet Q.

The recording head 40 may be, for example, an ink-jet head that forms an image on the sheet Q in accordance with an ink-jet system. The recoding head 40 may be a thermal head that forms an image on the sheet Q in accordance with a thermosensitive system or a thermal transfer system.

Under a condition that the recording head 40 forms an image in accordance with the ink-jet system, a fixer 45 for drying and fixing ink may be provided downstream of the recoding head 40 in the conveyance direction. As depicted by the dotted line in FIG. 1, the fixer 45 may be provided above the belt mechanism 30 such that the fixer 45 is adjacent to the recording head 40.

Figure 3:
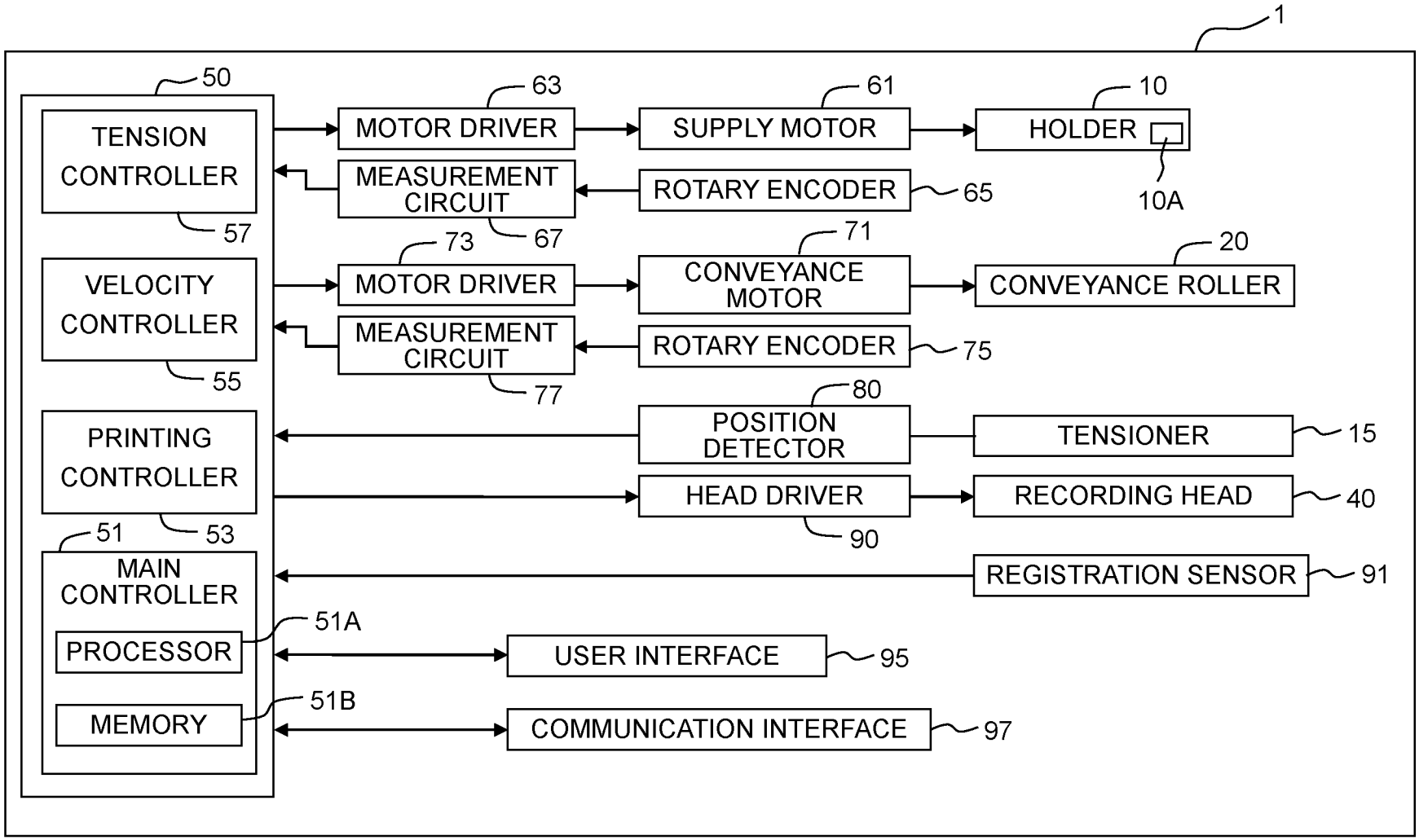
FIG. 3 is a block diagram of an electrical configuration of the image forming system.

Subsequently, an electrical configuration of the image forming system 1 is explained in detail. As depicted in FIG. 3, the image forming system 1 includes the controller 50 that controls an entire system. The image forming system 1 further includes a supply motor 61, a motor driver 63, a rotary encoder 65, and a measurement circuit 67 to control rotation of the sheet roll Q0 installed in the holder 10.

The supply motor 61 is connected to the rotation shaft 10A of the holder 10 via a gear (not depicted). The supply motor 61 applies power to the rotation shaft 10A. The rotation shaft 10A of the holder 10 rotates under a condition that the rotation shaft 10A receives power from the supply motor 61. The sheet roll Q0 rotates along with the rotation shaft 10A.

The supply motor 61 may be a direct-current motor (DC motor). The supply motor 61 drives the rotation shaft 10A by generating rotation torque depending on a drive current input from the motor driver 63. The motor driver 63 inputs, to the supply motor 61, a drive current depending on a control input $U_{SR}$ input from the controller 50.

The rotary encoder 65 is provided in the rotation shaft 10A of the holder 10 or a rotation shaft of the supply motor 61. The rotary encoder 65 outputs an encoder signal depending on rotation. The measurement circuit 67 measures a rotation position and a rotation velocity (i.e., rotation angle and angular velocity) of the sheet roll Q0 as a physical quantity related to the rotary motion of the sheet roll Q0. The measurement circuit 67 inputs, to the controller 50, the rotation position and the rotation velocity measured. The rotation position and the rotation velocity of the rotation shaft 10A correspond to the rotation position and the rotation velocity of the sheet roll Q0.

The image forming system 1 further includes a conveyance motor 71, a motor driver 73, a rotary encoder 75, and a measurement circuit 77 as the configuration for controlling the rotation of the conveyance roller 20.

The conveyance motor 71 may be a direct-current motor (DC motor). The conveyance motor 71 is connected to the conveyance roller 20 via a gear. The conveyance motor 71 rotates and drives the conveyance roller 20 by generating rotation torque depending on a drive current input from the motor driver 73. The motor driver 73 inputs, to the conveyance motor 71, a drive current depending on a control input $U_{PF}$ input from the controller 50.

The rotary encoder 75 is provided in a rotation shaft of the conveyance roller 20 or a rotation shaft of the conveyance motor 71. The rotary encoder 75 outputs an encoder signal depending on rotation. The measurement circuit 77 measures a rotation position and a rotation velocity (i.e., rotation angle and angular velocity) of the conveyance roller 20 as a physical quantity related to the rotary motion of the conveyance roller 20. The measurement circuit 77 inputs, to the controller 50, the rotation position and the rotation velocity measured.

The image forming system 1 further includes a position detector 80 that detects a position of the tensioner 15. The position detector 80 detects a position X in the front-rear direction of the tensioner 15 with reference to a predefined origin position. The position detector 80 inputs the detected position X to the controller 50. The position detector 80 may be configured, for example, by a linear encoder.

The image forming system 1 further includes a head driver 90, a registration sensor 91, a user interface 95, and a communication interface 97. The head driver 90 is configured to drive the recording head 40 in accordance with a control signal from the controller 50. The registration sensor 91 is provided upstream of the belt mechanism 30. The registration sensor 91 is configured to detect a leading edge of the sheet Q passing therethrough, and to input the detected signal to the controller 50.

The user interface 95 includes a display section for displaying a variety of information for a user and an input section for receiving instructions from the user. The display section is, for example, a liquid crystal display. The input section is, for example, a touch panel on the liquid crystal display.

The communication interface 97 is configured to communicate with an information device in the wired or wireless communication. The communication interface 97 may be a USB interface or a wired/wireless LAN interface. The information device may be a personal computer or a tablet terminal owned by the user.

The controller 50 includes a main controller 51, a printing controller 53, a velocity controller 55, and a tension controller 57. The main controller 51 includes a processor 51A and a memory 51B. The memory 51B includes a Random Access Memory (RAM) and a flush memory.

The processor 51A executes a variety of processes in accordance with computer programs stored in the memory 51B. In the following, it can be understood that processes executed by the main controller 51 are executed by the processor 51A in accordance with the computer program(s).

The printing controller 53, the velocity controller 55, and the tension controller 57 are configured, for example, by an ASIC. Image data of a printing object is input from the main controller 51 to the printing controller 53. The printing controller 53 inputs, to the head driver 90, a control signal for causing the recording head 40 to print an image based on the image data of the printing object.

The velocity controller 55 determines the control input $U_{PF}$ for the controller motor 71 so that the conveyance roller 20 rotates at a target rotation velocity in accordance with an instruction from the main controller 51. The velocity controller 55 inputs, to the motor driver 73, the control input $U_{PF}$ determined. In this embodiment, the control velocity of the sheet Q is controlled by controlling the rotation velocity of the conveyance roller 20.

The tension controller 57 determines the control input $U_{SR}$ for the supply motor 61 so that the sheet Q is conveyed while having target tension in accordance with an instruction from the main controller 51. The tension controller 57 inputs, to the motor driver 63, the control input $U_{SR}$ determined.

Figure 4:
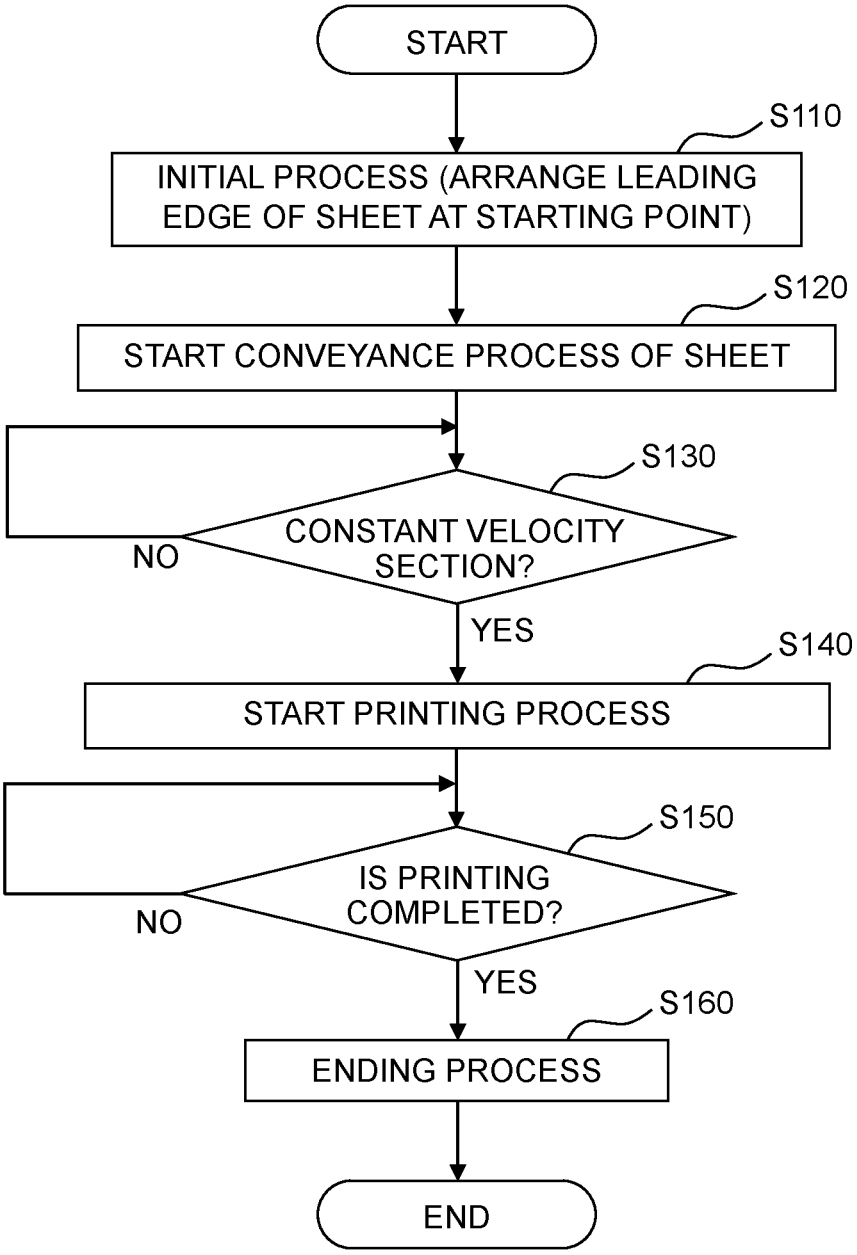
FIG. 4 is a flowchart of a process executed by a main controller.

Under a condition that the main controller 51 receives a printing instruction and image data of a printing object from an information device through the communication interface 97, the main controller 51 executes processes indicated in FIG. 4. The main controller 51 controls respective sections of the image forming system 1 in cooperation with the printing controller 53, the velocity controller 55, and the tension controller 57 so that an image based on the image data of the printing object received is formed on the sheet Q.

Under a condition that the processes indicated in FIG. 4 are started, the main controller 51 executes an initial process (S110). The initial process includes a process for arranging the leading edge of the sheet Q at a predefined starting point. The starting point may be a position where the leading edge of the sheet Q is detected by the registration sensor 91, or a position shifted downstream in the conveyance direction by a predefined distance from the position where the leading edge of the sheet Q is detected by the registration sensor 91.

The starting point may be a position where the leading edge of the sheet Q enters the belt mechanism 30. Alternatively, the starting point may be a point that is upstream in the conveyance direction from a position, where image formation is performed on the sheet Q by the recording head 40, by a distance required for acceleration of the sheet Q.

After arranging the leading edge of the sheet Q at the starting point, the main controller 51 starts a conveyance process of the sheet Q (S120). In the conveyance process, the main controller 51 inputs a velocity profile to the velocity controller 55. The velocity controller 55 controls the rotation velocity of the conveyance roller 20 in accordance with the velocity profile. The velocity profile indicates a target rotation velocity of the conveyance roller 20 until the sheet Q is stopped at a target stop position.

Specifically, the velocity profile indicates a target rotation velocity in an acceleration section, a target rotation velocity in a constant velocity section, and a target rotation velocity in a deceleration section. The sheet Q accelerates until the sheet Q reaches a predefined velocity by controlling the rotation velocity of the conveyance roller 20 in accordance with the velocity profile. After reaching the predefined velocity, the sheet Q moves at a constant velocity, and then decelerates.

In the conveyance process, the main controller 51 further inputs a tension profile to the tension controller 57. The tension controller 57 executes tension control of the sheet Q in accordance with the tension profile. The tension profile indicates target tension until the sheet Q is stopped at the target stop position.

After starting the conveyance process, the main controller 51 waits until the sheet Q reaches the predefined velocity (S130). The main controller 51 starts the printing process under a condition that the sheet Q starts constant velocity movement (S140). In the printing process, the main controller 51 causes the printing controller 53 to execute drive control of the recording head 40 for forming the image based on the image data of the printing object on the sheet Q. The recording head 40 repeatedly executes the image forming operation in the line direction in synchronization with movement in the conveyance direction of the sheet Q.

The main controller 51 executes an ending process (S160) under a condition that the printing process and the conveyance process are completed (S150: Yes). The ending process includes a process in which the user is informed of the completion of printing through the user interface 95. Then, the main controller 51 ends the processes indicated in FIG. 4.

Figure 5:
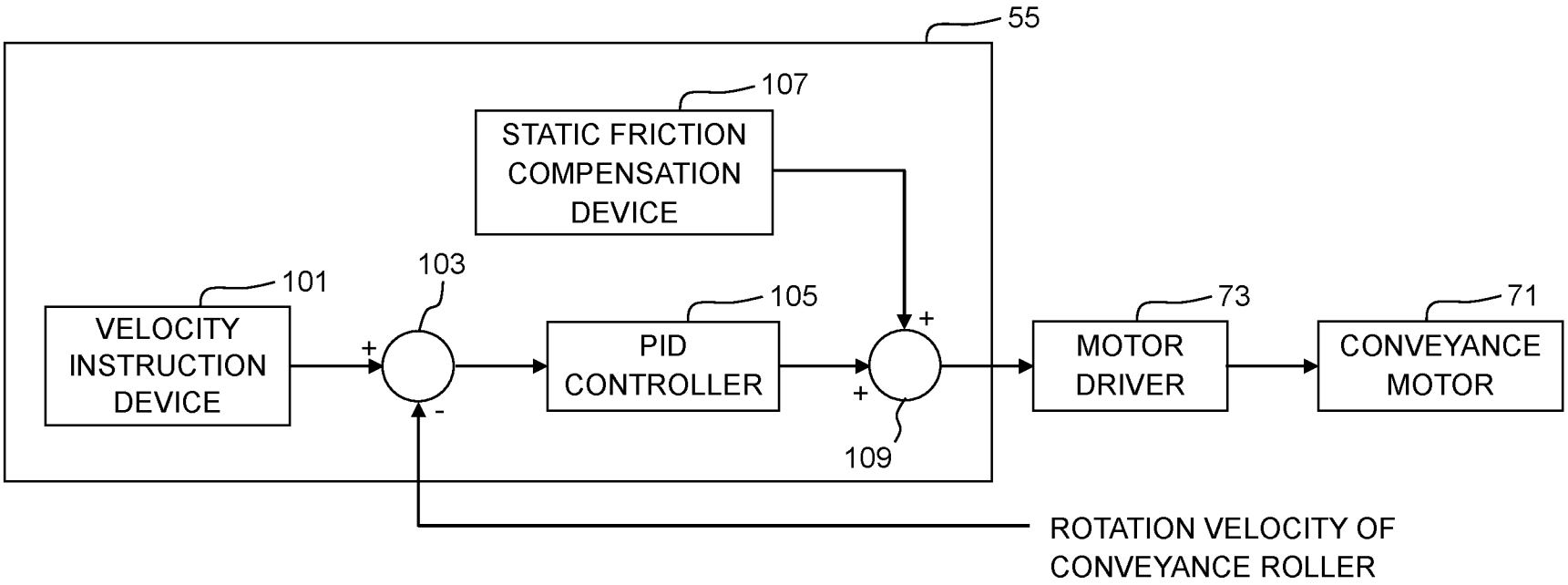
FIG. 5 is a block diagram of a velocity controller.

Referring to FIG. 5, a detailed configuration of the velocity controller 55 is explained below. The velocity controller 55 calculates the control input $U_{PF}$ for the conveyance motor 71 based on a deviation between the rotation velocity of the conveyance roller 20 measured by the measurement circuit 77 and the target rotation velocity. The velocity controller 55 is configured to execute feedback control for the conveyance roller 20 based on the control input $U_{PF}$ calculated. In the following, the actual rotation velocity means a measured value of the rotation velocity.

The velocity controller 55 includes a velocity instruction device 101, a deviation calculator 103, a PID controller 105, a static friction compensation device 107, and an adder 109. The velocity instruction device 101 outputs a target rotation velocity $\omega_r$ at each point of time from the start of control in accordance with the velocity profile input from the main controller 51.

The deviation calculator 103 calculates a deviation $E_V=(\omega_r-\omega_{PF})$ between the target rotation velocity $\omega_r$ output from the velocity instruction device 101 and an actual rotation velocity $\omega_{PF}$ input from the measurement circuit 77. The PID controller 105 calculates a control input $U_V$ for the conveyance motor 71 based on the deviation $E_V$ input from the deviation calculator 103.

The PID controller 105 includes: a proportional element that amplifies the deviation $E_V$ with a gain $G_p$ and outputs it; an integral element that amplifies an integral value $INT(E_V)$ of the deviation $E_V$ with a gain $G_i$ and outputs it; and a differential element that amplifies an integral value $DIF(E_V)$ of the deviation $E_V$ with a gain $G_d$ and outputs it. The PID controller 105 calculates a total of the output from the proportional element, the integral element, and the differential element as the control input $U_V$ for the conveyance motor 71.

The static friction compensation device 107 outputs a compensation amount C for compensating for the shortage of control input $U_V$ caused by static friction. The compensation amount C is a fixed value under a condition that the actual rotation velocity $\omega_{PF}$ is zero, that is, in a static state. The compensation amount C is zero under a condition that the actual rotation velocity $\omega_{PF}$ is not zero, that is, in a non-static state.

The adder 109 corrects the control input $U_V$ output from the PID controller 105 by the compensation amount C, and inputs, to the motor driver 73, a control input $U_{PF}=U_V+C$ after correction. The motor driver 73 inputs, to the conveyance motor 71, a drive current corresponding to the control input $U_{PF}$ input from the velocity controller 55, and drives the conveyance motor 71 so that rotation torque corresponding to the control input $U_{PF}$ is generated. The rotation velocity of the conveyance roller 20 and the conveyance velocity of the sheet Q corresponding to the rotation velocity of the conveyance roller 20 are subjected to the feedback control by the velocity controller 55.

Figure 6:
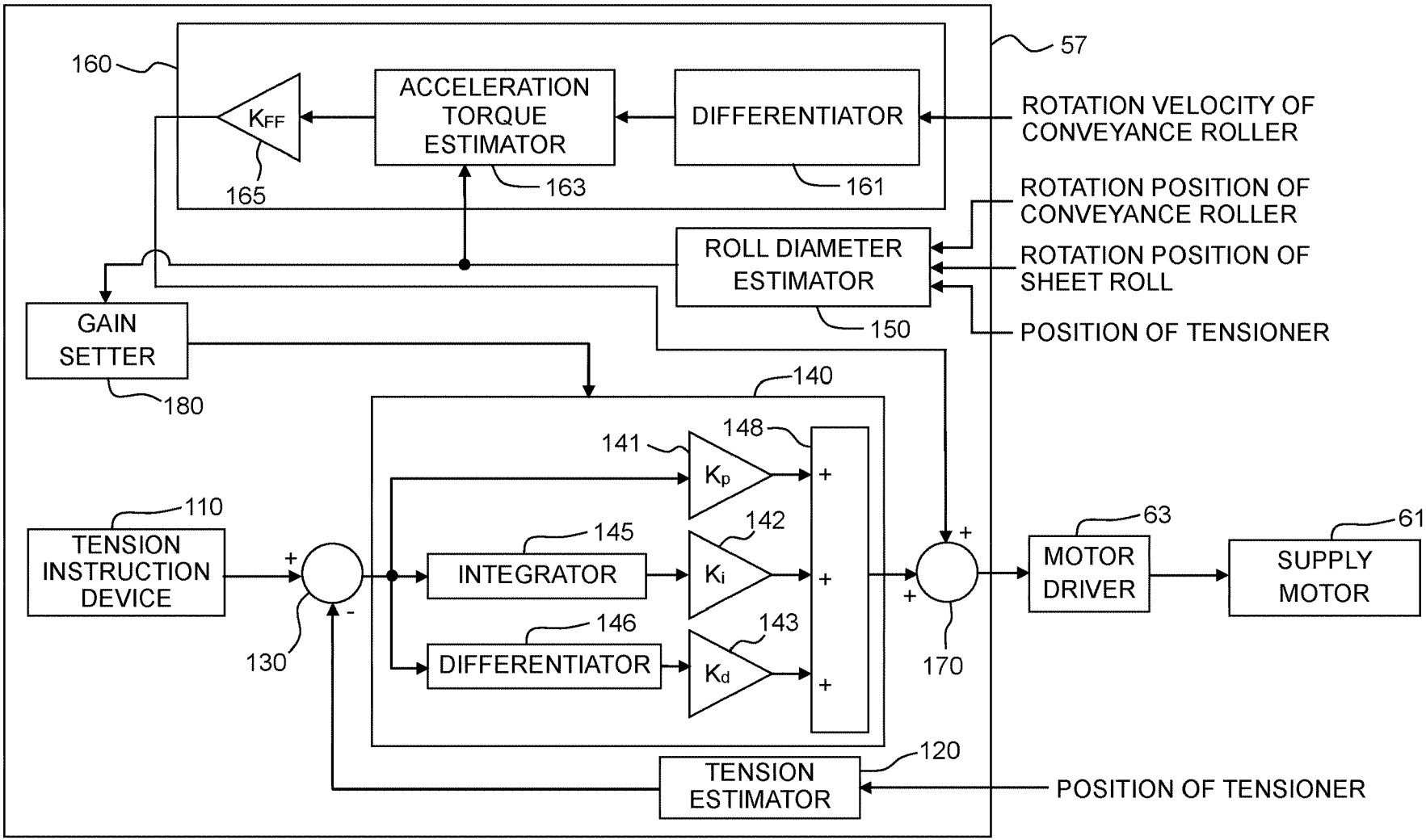
FIG. 6 is a block diagram of a configuration of a tension controller.

The tension control is executed by the tension controller 57 depicted in FIG. 6. The tension controller 57 calculates the control input $U_{SR}$ for the supply motor 61 based on a deviation between tension of the sheet Q estimated from the position X of the tensioner 15 detected by the position detector 80 (hereinafter referred to as estimated tension) and the target tension. The tension controller 57 thus executes the feedback control for the tension of the sheet Q based on the control input $U_{SR}$ calculated.

As depicted in FIG. 6, the tension controller 57 includes a tension instruction device 110, a tension estimator 120, a deviation calculator 130, a PID controller 140, a roll diameter estimator 150, a feedforward controller 160, an adder 170, and a gain setter (gain setting device) 180.

The tension instruction device 110 outputs target tension $T_r$ at each point of time from the start of control in accordance with the tension profile input from the main controller 51. The tension estimator 120 estimates tension T acting on the sheet Q based on the position X of the tensioner 15 input from the position detector 80. Specifically, the tension estimator 120 can calculate, as estimated tension T, a value $k \cdot X$ obtained by multiplying the position X of the tensioner 15 by a certain proportional efficient k.

The deviation calculator 130 calculates a deviation $E_T=T_r-T$ between the target tension $T_r$ and the estimated tension T. The PID controller 140 calculates a feed back control input $U_B$ for the supply motor 61 based on the deviation $E_T$ input from the deviation calculator 130.

As depicted in FIG. 6, the PID controller 140 includes a proportional gain amplifier 141, an integral gain amplifier 142, a differential gain amplifier 143, an integrator 145, a differentiator 146, and an adder 148. The deviation $E_T$ calculated by the deviation calculator 130 is input to the proportional gain amplifier 141, the integrator 145, and the differentiator 146. The proportional gain amplifier 141 amplifies the deviation $E_T$ input from the deviation calculator 130 with the gain $K_p$ and outputs it.

The integrator 145 executes integral calculation for the deviation $E_T$ and inputs an integral value $INT(E_T)$ of the deviation $E_T$ to the integral gain amplifier 142. The integral gain amplifier 142 amplifies the integral value $INT(E_T)$ of the deviation $E_T$ input from the integrator 145 with a gain $K_i$ and outputs it.

The differentiator 146 executes differential calculation for the deviation $E_T$, and inputs a differential value $DIF(E_T)$ of the deviation $E_T$ to the differential gain amplifier 143. The differential gain amplifier 143 amplifies the differential value $DIF(E_T)$ of the deviation $E_T$ input from the differentiator 146 with a gain $K_d$ and outputs it.

The adder 148 adds $K_p \cdot E_T$ output from the proportional gain amplifier 141, $K_i \cdot INT(E_T)$ output from the integral gain amplifier 142, and $K_d \cdot DIF(E_T)$ output from the differential gain amplifier 143. The adder 148 outputs an addition value $K_p \cdot E_T+K_i \cdot INT(E_T)+K_d \cdot DIF(E_T)$ as the feedback control input $U_B$ for the supply motor 61.

The adder 170 outputs an addition value $U_B+U_F$ obtained by adding the feedback control input $U_B$ input from the PID controller 140 and a feedforward control input $U_F$ input from the feedforward controller 160 as the control input $U_{SR}$ for the supply motor 61.

The feedforward controller 160 includes a differentiator 161, an acceleration torque estimator 163, and an FF gain amplifier 165. The differentiator 161 differentiates the rotation velocity $\omega_{PF}$ of the conveyance roller 20 input from the measurement circuit 77 to calculate rotation acceleration $\alpha$ of the conveyance roller 20. The rotation acceleration corresponds to angle acceleration. In the following, the rotation acceleration $\alpha$ calculated from the differentiator 161 is expressed as an actual rotation acceleration $\alpha$.

The acceleration torque estimator 163 estimates acceleration torque $\tau$ of the supply motor 61 required for acceleration of the conveyance roller 20 based on the actual rotation acceleration $\alpha$, in other words, required for rotation of the sheet roll Q0 depending on the acceleration of the sheet Q. Specifically, the acceleration torque $\tau$ is calculated in accordance with an equation $\tau=J(R)\cdot(R_P/R)\cdot\alpha$ based on the actual rotation acceleration $\alpha$, the roll diameter R that is a radius of the sheet roll Q0, a radius $R_P$ of the conveyance roller 20, and an inertia J(R) of the sheet Q0 estimated from the roll diameter R.

Under a condition that the rotation acceleration of the conveyance roller 20 is $\alpha$, the acceleration of the sheet Q conveyed by the rotation of the conveyance roller 20 is $R_P\cdot\alpha$. The sheet roll Q0 is required to rotate at rotation acceleration $(R_P/R)\cdot\alpha$ to pull out the sheet Q from the sheet roll Q0 at the same acceleration. Under a condition that the inertia is J, the acceleration torque required for achieving this rotation is $J\cdot(R_P/R)\cdot\alpha$.

A function J(R) for calculating the inertia J(R) of the sheet roll Q0 with the roll diameter being R is prepared in advance. The radius $R_P$ of the conveyance roller 20 is a fixed value of the image forming system 1. The roller diameter R of the sheet roll Q0 is estimated by the roll diameter estimator 150 (details thereof are described below).

The acceleration torque estimator 163 calculates the acceleration torque $\tau$ based on the above equation and information of the roll diameter R input from the roll diameter estimator 150. The FF gain amplifier 165 adjusts the acceleration torque $\tau$ calculated so that the acceleration torque $\tau$ calculated is amplified by a gain $K_{FF}$, and outputs an acceleration torque $K_{FF}\cdot\tau$ after adjustment as the feedforward control input $U_F$. The gain $K_{FF}$ is normally a value 1, and the gain $K_{FF}$ may be finely adjusted from the value 1 depending on machine characteristics of a rotation system.

The motor driver 63 inputs a drive current corresponding to the control input $U_{SR}=U_F+U_B$ to the supply motor 61, and drives the supply motor 61 so that rotation torque corresponding to the control input $U_{SR}$ is generated. The tension of the sheet Q is controlled to the target tension by executing the feedforward control and the feedback control for the supply motor 61.

In this embodiment, the gain setter 180 is configured to adjust the gains $K_p$, $K_i$, and $K_d$ in the PID controller 140 based on the roll diameter R estimated by the roll diameter estimator 150. The gains $K_p$, $K_i$, and $K_d$ are set to $K_p=K_p(R)$, $K_i=K_i(R)$, $K_d=K_d(R)$ in accordance with the functions $K_p(R)$, $K_i(R)$, and $K_d(R)$ of which variables are the roll diameter R. The functions $K_p(R)$, $K_i(R)$, and $K_d(R)$ are determined in advance through an examination.

Subsequently, an estimation operation of the roll diameter R by the roll diameter estimator 150 is explained. The roll diameter estimator 150 estimates the roll diameter R for each sampling period $t_s$ by executing the processes in FIG. 7 (S260). The processes in FIG. 7 are started under a condition that the conveyance of the sheet Q is started, and the processes in FIG. 7 are ended under a condition that the conveyance of the sheet Q is ended.

Figure 7:
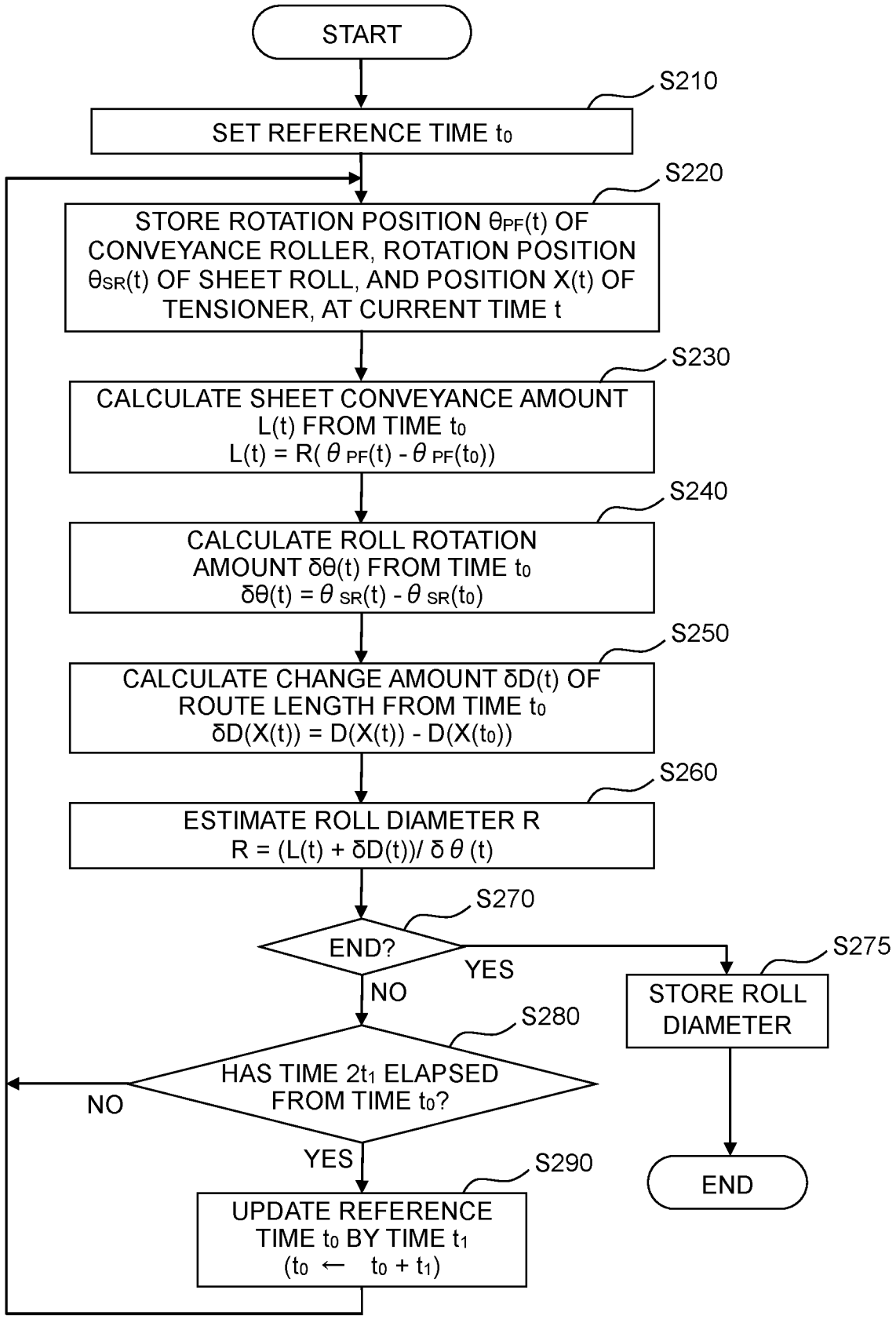
FIG. 7 is a flowchart of a process executed by a roll diameter estimator.

Under the condition that the processes in FIG. 7 are started, the roll diameter estimator 150 sets a current time t as a reference time $T_0$ (S210). Until conditions for starting the estimation of the roll diameter R are satisfied, the roll diameter estimator 150 accumulates and stores a rotation position $\theta_{PF}(t)$ of the conveyance roller 20, a rotation position $\theta_{SR}(t)$ of the sheet roll Q0, and a position X(t) of the tensioner 15 for each sampling period $t_s$, as data required for the estimation of the roll diameter R (S210).

The period until the estimation starting conditions are satisfied may be a period from the reference time $t_0$ until a predefined time $t_1$ described below elapses, or a period shorter than said period. The rotation position $\theta_{PF}(t)$ indicates a rotation position $\theta_{PF}$ of the conveyance roller 20 measured by the measurement circuit 77 at the time t. The rotation position $\theta_{SR}(t)$ indicates a rotation position $\theta_{SR}$ of the sheet roll Q0 measured by the measurement circuit 67 at the time t. The position X(t) indicates a position X of the tensioner 15 detected by the position detector 80 at the time t.

After completing the process of S210, the roll diameter estimator 150 repeatedly executes the processes of S220 to S290 for each sampling period $t_s$. In S220, the roll diameter estimator 150 stores the rotation position $\theta_{PF}(t)$ of the conveyance roller 20, the rotation position $\theta_{SR}(t)$ of the sheet roll Q0, and the position X(t) of the tensioner 15 at the current time t.

After that, the roller diameter estimator 150 calculates a sheet conveyance amount L(t) from the reference time $t_0$ to the current time t based on the radius $R_p$ of the conveyance roller 20, a rotation position $\theta_{PF}(t_0)$ of the conveyance roller 20 at the reference time $t_0$, and the rotation position $\theta_{PF}(t)$ of the conveyance roller 20 at the current time t (S230). Specifically, the roll diameter estimator 150 calculates the sheet conveyance amount L(t) in accordance with an equation $L(t)=R_p\cdot(\theta_{PF}(t)-\theta_{PF}(t_0))$.

The roll diameter estimator 150 calculates a rotation amount $\delta\theta(t)$ of the sheet roll Q0 from the referent time $T_0$ to the current time t (S240). In the following, a rotation amount of the sheet roll Q0 is also referred to as a roll rotation amount.

In S240, the roll diameter estimator 150 calculates the roll rotation amount $\delta\theta(t)(=\theta_{SR}(t)-\theta_{SR}(t_0))$ based on the rotation position $\theta_{SR}(t_0)$ of the sheet roll Q0 at the reference time to and the rotation position $\theta_{SR}(t)$ of the sheet roll Q0 at the current time t. The roll rotation amount $\delta\theta(t)$ is calculated by a dimension of an angle that does not require information of the roll diameter R.

The roll diameter estimator 150 calculates a change amount $\delta D(t)$ of a route length D from the reference time $t_0$ to the current time t (S250). Here, the route length D means a length of the conveyance route from the point P1 to the point P2 depicted in FIG. 1. In other words, the route length D is coincident with a length of the sheet Q from the point P1 to the point P2.

Figure 8:
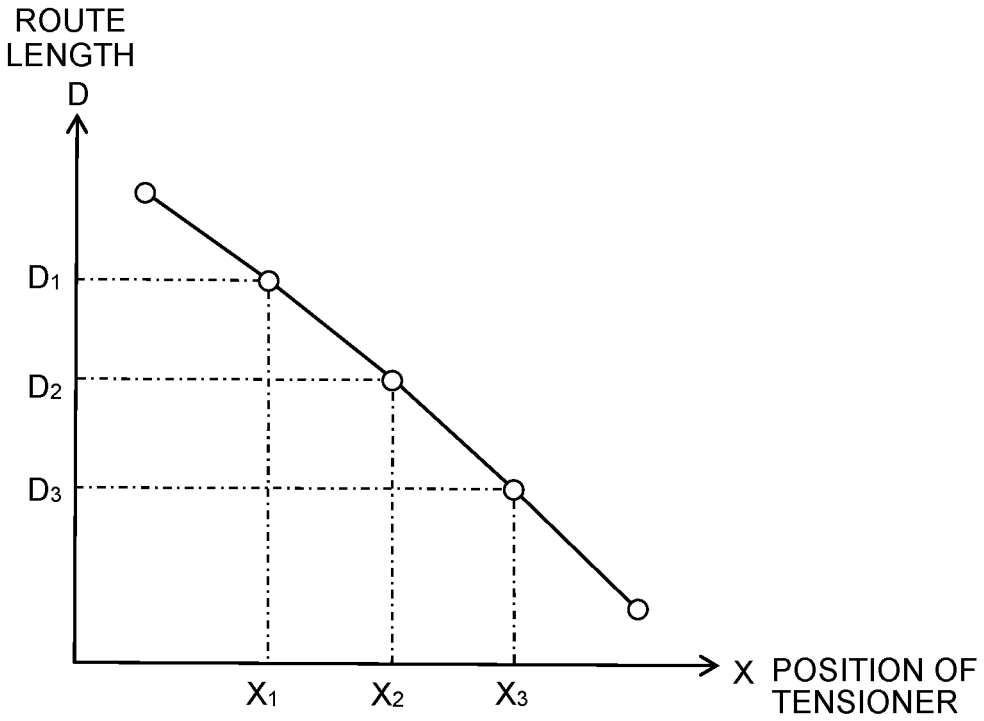
FIG. 8 is a graph indicating relationships between tensioner positions and route lengths.

The tensioner 15 has flexibility. Change in the position X of the tensioner 15 changes the length of the conveyance route from the point P1 to the point P2 as depicted in FIG. 2. As depicted in FIG. 8, the route length D is shorter as the position X of the tensioner 15 increases, that is, the route length D is shorter as the tensioner 15 moves forward.

The roll diameter estimator 150 calculates a route length D(X(t)) corresponding to the position X(t) of the tensioner 15 at the current time t. Further, the roll diameter estimator 150 calculates a route length $D(X(t_0))$ corresponding to a position $X(t_0)$ of the tensioner 15 at the reference time $T_0$.

The roll diameter estimator 150 calculates the route lengths $D(X(t_0))$, $D(X(t))$ in accordance with a table or a function $D(X)$ indicating correspondence relationships between the positions X and the route lengths D stored in advance.

The function $D(X)$ may be theoretically derived based on a geometrical relationship between the position X of the tensioner 15 and the points P1, P2. Regarding the position X and the route length D, route lengths $D_1$, $D_2$, $D_3$ . . . in the respective positions $X_1$, $X_2$, $X_3$ . . . are measured, and the function $D(X)$ may be calculated by fitting the function to the measured data.

The roll diameter estimator 150 may include a table that stores the route lengths $D_1$, $D_2$, $D_3$ . . . in the respective positions $X_1$, $X_2$, $X_3$ . . . . The roll diameter estimator 150 may refer to the table and may calculate the route lengths $D(X(t_0))$, $D(X(t))$ corresponding to the positions $X(t_0)$, $X(t)$ through liner interpolation.

In S250, the roll diameter estimator 150 calculates a change amount of the route length D $\delta D(t)$ $(=D(X(t))-D(X(t_0))$ based on the calculated route lengths $D(X(t_0))$, $D(X(t))$.

After that, the roll diameter estimator 150 calculates the roll diameter R of the sheet roll Q0 $(=(L(t)+\delta D(t))/\delta D(t))$ as an estimated value based on the sheet conveyance amount $L(t)$, the rotation amount $\delta D(t)$ of the sheet roll Q0, and the change amount $\delta D(t)$ of the route length D (S260).

$(L(t)+\delta D(t))$ corresponds to the length of the sheet Q that is pulled out from the sheet roll Q0 from the reference time $t_0$ to the time t. $\delta\theta(t)$ corresponds to the rotation amount of the sheet roll Q0 under a condition that the sheet Q is pulled out by a length $(L(t)+\delta D(t))$.

It is thus possible to calculate the radius R of the sheet roll Q0 under a condition that the sheet Q is conveyed by the length $(L(t)+\delta D(t))$ in accordance with the equation $R=(L(t)+\delta D(t))/\delta D(t)$. According to this equation, the radius R can be calculated accurately under a condition that the radius R is approximately constant from the time $t_0$ to the time t.

After calculating the roll diameter R in S260, the roll diameter estimator 150 determines whether end conditions are satisfied in S270. Under a condition that the roll diameter estimator 150 has determined that the end conditions are satisfied (S270: Yes), the roll diameter estimator 150 ends the processes in FIG. 7. Before ending the processes in FIG. 7, the roll diameter estimator 150 causes the main controller 51 to save, in the memory 51B, the roll diameter R calculated in S260 as the latest estimated value of the roll diameter R (S275).

The roll diameter estimator 150 determines that the end conditions are satisfied (S270: Yes) under a condition that the sheet conveyance is normally ended and under a condition that the sheet conveyance is abnormally ended. Then, the roll diameter estimator 150 ends the processes in FIG. 7.

Under a condition that the roll diameter estimator 150 has determined that the end conditions are not satisfied (S270: No), the roll diameter estimator 150 determines whether a time $2t_1$ that is twice as long as the predefined time $t_1$ has elapsed from the reference time $t_0$ (S280). Under a condition that the roll diameter estimator 150 has determined that the time $2t_1$ has not elapsed (S280: No), the roll diameter estimator 150 executes the process of S220.

Under a condition that the roller diameter estimator 150 has determined in S280 that the time $2t_1$ has elapsed (S280: Yes), the roll diameter estimator 150 updates the reference time $t_0$ to a time $(t_0+t_1)$ elapsed from the reference time $t_0$ by the time $t_1$ (S290). Then, the roll diameter estimator 150 executes the process of S220. As described above, the roll diameter estimator 150 executes the processes of S220 to S290 for each sampling period $t_s$. In S260, the roll diameter estimator 150 estimates the roll diameter R.

Figure 9:
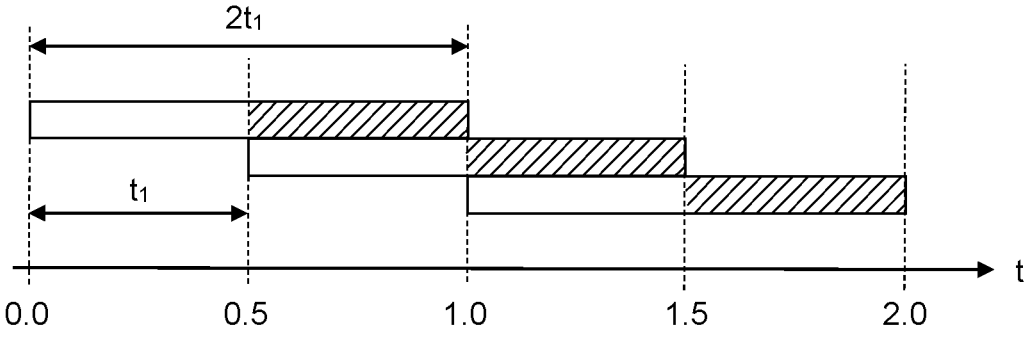
FIG. 9 illustrates a method of estimating a roll diameter.

In FIG. 9, each broken line indicates a state where the reference time $t_0$ is shifted every time $t_1$. In FIG. 9, the time $t_1$ is 0.5 seconds. The roll diameter estimator 150 calculates the roll diameter R for each sampling period $t_s$ during each period from the time $(t_0+t_1)$ to a time $(t_0+2t_1)$ hatched in FIG. 9. In this case, the sampling period $t_s$ may be one millisecond.

Figure 10:
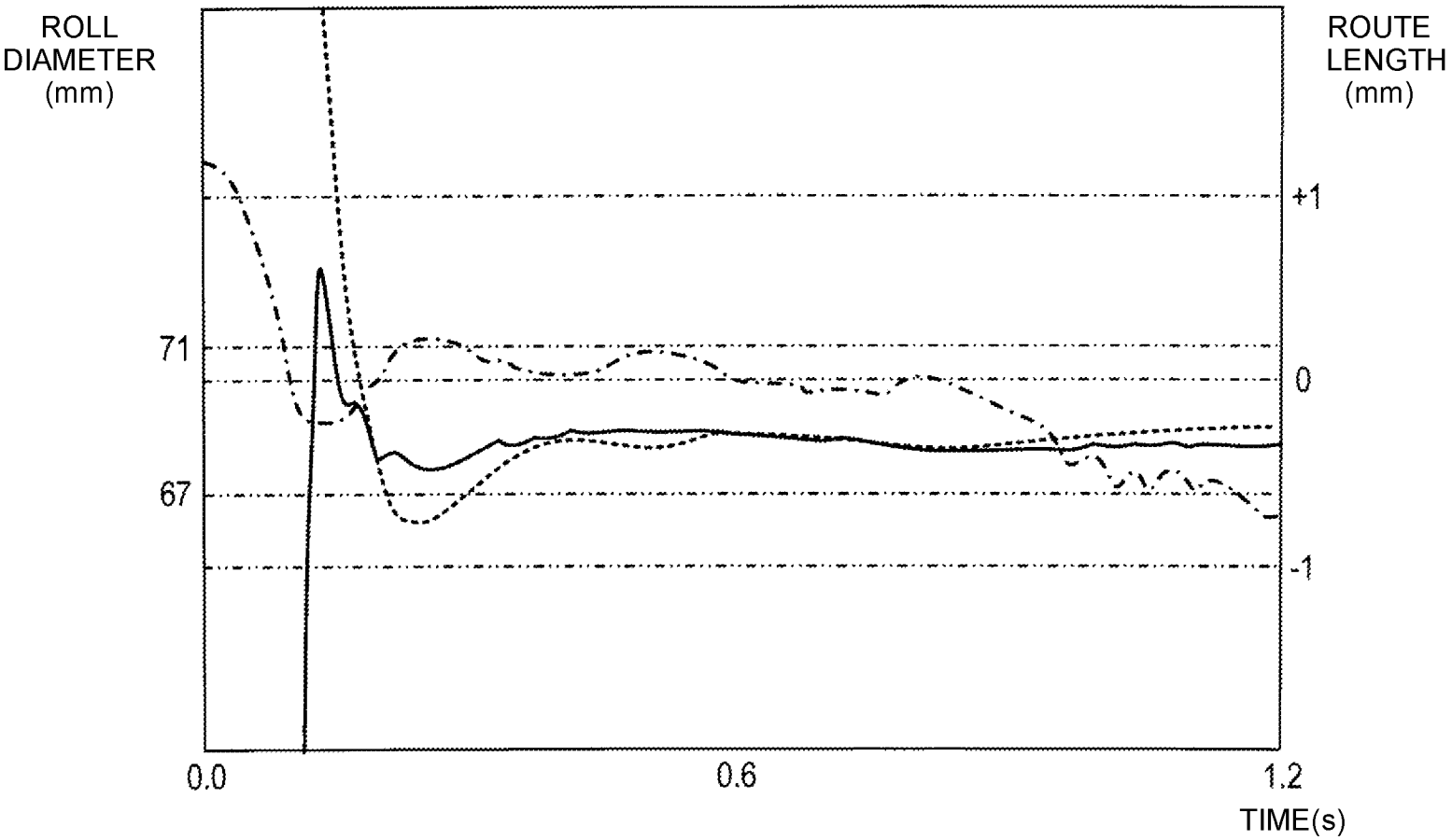
FIG. 10 is a graph indicating a change in an estimated value of the roll diameter.

In FIG. 10, change in the roll diameter R calculated by the above method is indicated by a solid line. In FIG. 10, a correct roll diameter R is 69 mm. It can be evaluated that the roll diameter R is calculated accurately under a condition that the roll diameter R calculated is in a range of 67 to 71 mm.

In this embodiment, the roll diameter R is calculated by including not only the conveyance amount $L(t)$ of the sheet Q by the conveyance roller 20 but also the change amount $\delta D(t)$ of the route length D. It is thus possible to estimate the roll diameter R quickly and accurately.

In FIG. 10, a broken line indicates a roll diameter R' estimated in accordance with an equation $R'=L(t)/\delta\theta(t)$ without including the change amount $\delta D(t)$ of the route length D. As understood from a comparison between the roll diameter R indicated by the solid line and the roll diameter R' indicated by the broken line, it is possible to estimate the roll diameter R more quickly and accurately by the technique of the present disclosure in which the change amount $\delta D(t)$ of the route length D is included, than a case where the change amount $\delta D(t)$ is not included. A dot-dash chain line in FIG. 10 indicates a difference of the route length D from a specific route length $D_0$.

Figure 11:
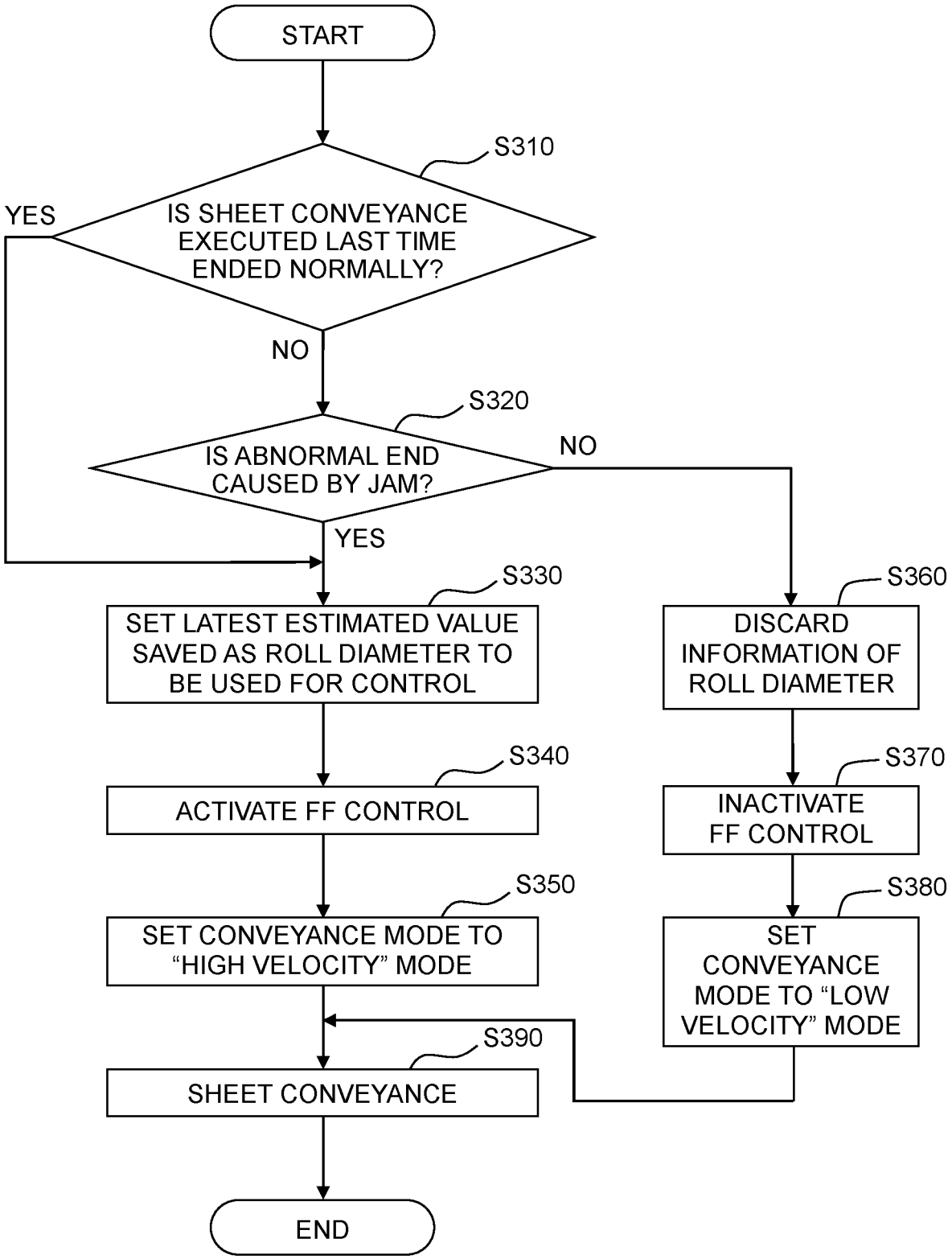
FIG. 11 is a flowchart indicating part of an initial process.

Referring to FIG. 11, details of the initial process (S110 in FIG. 4) executed by the main controller 51 are explained. Under a condition that the initial process is started (S110), the main controller 51 determines whether the sheet conveyance executed last time (executed previously or most recently) is ended normally (S310).

Under a condition that the main controller 51 has determined that the initial process is ended normally (S310: Yes), the main controller 51 executes a process of S330. Under a condition that the main controller 51 has determined that the initial process is ended abnormally (S310: No), the main controller 51 determines whether the previous abnormal end (last abnormal end) is caused by a jam (S320).

Under a condition that the main controller 51 has determined that the previous abnormal end is caused by the jam (S320: Yes), the main controller 51 executes the process of S330. Under a condition that the main controller 51 has determined that the previous abnormal end is caused by any other cause than the jam (S320: No), the main controller 51 executes a process of S360.

The abnormal end due to any other cause than the jam may be an abnormal end caused under a condition that the sheet Q of the sheet roll Q0 is used up or finished up. Under the condition that the sheet roll Q is used up, a new sheet roll Q0 is installed in the holder 10. Under a condition that the previous sheet conveyance (last sheet conveyance) is not executed, the main controller 51 formally determines as "No" in S310 and S320, and executes the process of S360.

In S330, the main controller 51 sets a latest estimated value saved in the memory 51B as the roll diameter R of the sheet roll Q0 to be used for the tension control performed in a period until the estimation of the roll diameter R is started.

Specifically, the main controller 51 sets the latest estimated value read from the memory 51B, as a current roll diameter R, for the feedforward controller 160 and the gain setter 180 included in the tension controller 57. Under a condition that the roll diameter estimator 150 newly estimates the roll diameter R, the roll diameter R set in the feedforward controller 160 and the gain setter 180 is updated to the newly estimated value.

After executing the process of S330, the main controller 51 activates the feedforward control of the tension controller 57 by permitting operation of the feedforward controller 160 (S340).

Further, the main controller 51 inputs a velocity profile for the high velocity conveyance, as a velocity profile that defines the target rotation velocity of the conveyance roller 20, to the velocity controller 55. Accordingly, the conveyance mode of the sheet Q is set to a "high velocity" mode (S350).

After that, the main controller 51 executes a process of S390. In S390, the main controller 51 causes the velocity controller 55 and the tension controller 77 to execute the rotation velocity control and the tension control so that the sheet Q is conveyed with high velocity to the starting point in accordance with the velocity profile input in S350. Then, the main controller 51 ends the processes in FIG. 11.

In S360, the main controller 51 discards the latest estimated value of the roll diameter R saved in the memory 51B. Then, the main controller 51 invalidates the feedforward control by prohibiting operation of the feedforward controller 160 (S370).

In S380, the main controller 51 inputs a velocity profile for low velocity conveyance to the velocity controller 55, and sets the conveyance mode of the sheet Q to a "low velocity" mode. In the velocity profile for the lower velocity mode, the target rotation velocity in the constant velocity section after the sheet Q reaches a maximum velocity is lower than that in the high velocity mode.

After that, the main controller 51 causes the velocity controller 55 and the tension controller 77 to execute the rotation velocity control and the tension control so that the sheet Q is conveyed with low velocity to the starting point in accordance with the velocity profile input in S380. Then, the main controller 51 ends the processes in FIG. 11.

The operation prohibition state of the feedforward controller 160 during the low velocity conveyance is maintained until the estimation of the roll diameter R by the roll diameter estimator 150 is newly started. In other words, the feedforward controller 160 can calculate the feedforward control input $U_F$ based on the roll diameter R under a condition that information of the roll diameter R that is newly estimated by the roll diameter estimator 150 is obtained.

In addition, under a condition that the latest estimated value of the roll diameter R is discarded in S360, the gain setter 180 sets, to the PID controller 140, gains $K_p=K_d(R_s)$, $K_i=K_i(R_s)$, and $K_d=K_d(R_s)$ in accordance with a standard roll diameter $R_s$ given from the main controller 51 until the roll diameter R is newly estimated by the roll diameter estimator 150.

In the image forming system 1 of this embodiment described above, the roll diameter estimator 150 of the controller 50 estimates the roll diameter R, which is a radius of the sheet roll Q0, based on the sheet conveyance amount L(t) measured, the rotation amount δθ(t) of the sheet roll Q0 measured, and the position X of the tensioner 15 detected.

Specifically, the roll diameter estimator 150 estimates the change amount δD(t) of the conveyance route length D(t) of the sheet Q from the first point P1 where the sheet Q is pulled out from the sheet roll Q0 to the second point P2 where the sheet Q is nipped between the conveyance roller 20 and the nip roller 25, based on the position X(t) of the tensioner 15.

The roll diameter estimator 150 estimates the roll diameter R based on the roll rotation amount δθ(t) and a pulling-out amount of the sheet Q (L(t)+δD(t)) determined from the sheet conveyance amount L(t) caused by the rotation of the conveyance roller 20 and the change amount δD(t) of the route length D(t).

Specifically, the roll diameter estimator 150 estimates the roll diameter R (=(L(t)+δD(t))/δD(t)) based on the sheet conveyance amount L(t), the roll rotation amount δθ(t) of the sheet roll Q0, and the change amount δD(t) of the route length D during a period $t_0$ to t from the reference time $T_0$ to an estimated time t.

Thus, in the image forming system 1 of this embodiment, the roll diameter R can be estimated with high accuracy without providing a dedicated sensor such as an optical distance sensor even under a condition that the change in the position X of the tensioner 15 changes the posture and the route length D of the sheet Q. In other words, it is possible to estimate the roll diameter R with high accuracy without actually measuring the roll diameter R by the dedicated sensor.

In this embodiment, as depicted in FIG. 9, the roll diameter estimator 150 updates the reference time $t_0$ to a time elapsed from the reference time $t_0$ by the time $t_1$ every time the time $2_{t1}$ elapses from the reference time $t_0$. The roll diameter estimator 150 estimates, for each sampling period $t_s$, the roll diameter R based on the sheet conveyance amount L(t), the rotation amount δθ(t) of the sheet roll Q0, and the change amount δD(t) of the route length D during a period from the reference time $t_0$ to the time t.

In this embodiment, the roll diameter R at the time t is estimated based on an observation value related to the sheet conveyance during the observation period $t_0$ to t. The observation period is updated to partially overlap with the last observation period (previous observation period), thus continuously changing the observation period. Accordingly, in this embodiment, it is possible to inhibit a high-frequency error component of the roll diameter R estimated and to estimate the roll diameter R stably compared to a case where the observation period is updated not to overlap with the last observation period.

Further, in this embodiment, the roll diameter R estimated by the roll diameter estimator 150 is stored in the memory 51B under a condition that the sheet conveyance ends (S275). In the next sheet conveyance, the feedforward control input $U_F$ is calculated based on the roll diameter R stored last time (stored most recently or previously) until the estimation of the roll diameter R is started by the roll dimeter estimator 150. The supply motor 61 is controlled by the control input $U_{SR}$ based on the feedforward control input $U_F$ and the feedback control input $U_B$ calculated.

However, under a condition that the last sheet conveyance is ended abnormally and this abnormal end is caused by any other cause than the jam, the roll diameter R saved last time (saved most recently or previously) is discarded and the feedforward control is inactivated in view of the possibility that sheet roll Q0 is being replaced. That is, the tension controller 57 controls the rotation of the supply motor 61 only by the feedback control, in other words, only by the feedback control input $U_B$.

However, under the condition that only the feedback control is used to control the rotation of the supply motor 61, a conveyance error of the sheet Q until the sheet Q is arranged at the starting point may be larger than a case where the sheet Q is conveyed using the feedforward control and the feedback control. Thus, in this embodiment, under the condition that the feedforward control is inactivated, the velocity profile for low velocity conveyance is set in the velocity controller 55 and the sheet Q is conveyed at low velocity.

That is, under the condition that the supply motor 61 is controlled by the feedforward control and the feedback control, the sheet Q is conveyed at high velocity through the control of the controller 20 based on the velocity profile for high velocity conveyance. Under the condition that the supply motor 61 is controlled only by the feedback control, the sheet Q is conveyed at low velocity through the control of the conveyance roller 20 based on the velocity profile for low velocity conveyance.

Thus, in this embodiment, it is possible to inhibit deterioration in control accuracy by executing the conveyance control so that the sheet Q is conveyed at low velocity even under a condition that the control with high accuracy can not be executed due to the shortage of information of the roll diameter R. If the sheet Q is arranged at the starting point with low control accuracy, the sheet Q is liable to be excessively conveyed due to the control error and the sheet Q may come into contact with the recording head 40. In this embodiment, the conveyance control of the sheet Q at low velocity can inhibit such a problem.

As described above, in this embodiment, under the condition that the abnormal end is caused by any other cause than the jam, the feedforward control that needs the information of the roll diameter R is inactivated. The reason thereof is that there is possibility that the sheet roll Q0 is being replaced and a degree of the accuracy in which the roll diameter R is the last estimated value is low.

As understood from this context, the processes of S310 and S320 correspond to determination whether or not the roll diameter R saved in the memory 51B is accurate. Thus, the inactivation of the feedforward control may be executed by any other method than the processes of S310 and S320 through which it is determined whether or not the roll diameter R saved in the memory 51B is accurate.

Under a condition that the controller 50 has determined that the accuracy of the roll diameter R saved in the memory 51B is high, the feedforward control can be executed based on the latest estimated value of the roll diameter R saved last time (saved most recently or previously) in the memory 51B until the estimation of the roll diameter R by the roll diameter estimator 150 is started. Under a condition that the controller 50 has determined that the accuracy is low, the feedforward control can be inactivated.

Subsequently, image forming systems 1 according to the second embodiment and the third embodiment are explained below. The image forming systems 1 according to the second and third embodiments are modified examples of the image forming system 1 according to the first embodiment.

In the following, configurations and processes of the image forming systems 1 according to the second and third embodiments that are different from those of the first embodiment are selectively explained. The configurations and processes similar to those of the first embodiment are designated by the same reference numerals and step numbers as the first embodiment, and explanation therefor is omitted.

Second Embodiment

Figure 12:
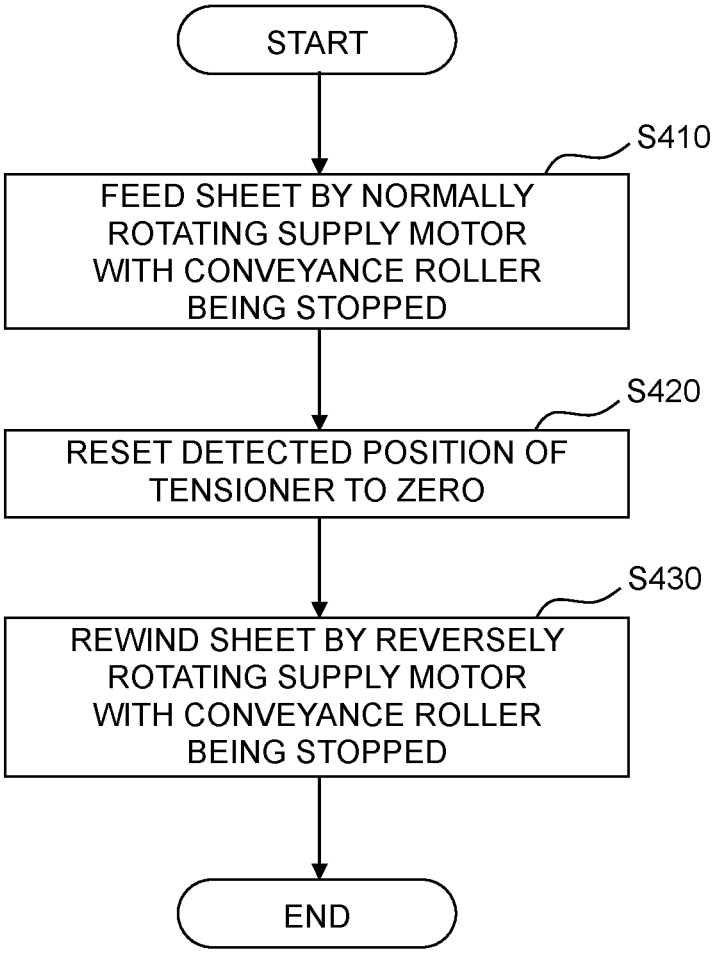
FIG. 12 is a flowchart of an origin setting process executed by the main controller in the second embodiment.

The image forming system 1 according to the second embodiment is configured so that the main controller 51 executes an origin setting process indicated in FIG. 12.

In the origin setting process, the position X of the tensioner 15 detected by the position detector 80 is set to zero at the origin position of the tensioner 15. The origin setting process is thus executed immediately after the image forming system 1 starts up before the conveyance process of the sheet Q starts. The origin setting process may be executed before or after the leading edge of the sheet Q is arranged at the starting point defined in advance in the initial process (S110).

The origin position of the tensioner 15 is a position where the tensioner 15 is static under a condition that the spring material 16 has a natural length and no elastic force from the spring material 16 is generated. Under a condition that the tensioner 15 is in the origin position, the tension of the sheet Q acting on the tensioner 15 is zero.

Under a condition that the origin setting process starts, the main controller 51 sends or feeds the sheet Q by rotating the supply motor 61 in a normal rotation direction by a predefined amount in a state where the conveyance roller 20 is stopped (S410). The normal rotation direction of the supply motor 61 is a rotation direction in which the sheet Q moves in the conveyance direction.

The predefined amount is previously set to a feeding amount of the sheet Q to result in the following situation. That is, even under a condition that the tensioner 15 is in a limit position corresponding to maximum tension before the process of S410, the sheet Q being fed or sent out flexes or bends to lose the tension of the sheet Q, and the tensioner 15 moves to the origin position and is static at the origin position.

Thus, under a condition that the process of S410 is completed, the tensioner 15 typically moves to the origin position. The main controller 51 determines that the tensioner 15 is in the origin position and resets the detected position X of the tensioner 15 detected by the position detector 80 to zero (S420). The initial setting of the position detector 80 is executed as described above so that the position X of the tensioner 15 is detected as a relative position from the origin position.

After that, the main controller 51 rewinds the sheet Q by reversely rotating the supply motor 61 in a state where the conveyance roller 20 is stopped, and ends the origin setting process indicated in FIG. 12 (S430).

In S430, the main controller 51 controls, based on the position X of the tensioner 15 detected by the position detector 80, the supply motor 61 through the tension controller 57. In this configuration, the rewinding of the sheet Q is completed under a condition that the tension of the sheet Q reaches predefined constant tension determined in advance. The constant tension may be the target tension under a condition that the sheet Q is conveyed thereafter.

As described above, the position detector 80 may be the linear encoder. The linear encoder may be an encoder that has a fixed mechanical origin position on an encoder scale to detect a position with reference to the origin position, an encoder that can detect a position as a relative position from a position reset by software, or the like.

According to the second embodiment, the tension of the sheet Q can be accurately estimated based on the detected position X by the position detector 80 also under a condition that the latter encoder is used as the position detector 80.

Third Embodiment

Subsequently, the image forming system 1 of the third embodiment is explained. The image forming system 1 of the third embodiment is configured to estimate the roll diameter r by estimating a state quantity related to the rotation system of the sheet roll Q0 by use of an extended Kalman filter. Although the roll diameter is explained using the variable R in the first embodiment, the roll diameter is explained using a variable r in the third embodiment.

The Kalman filter is a technique in which the state quantity is estimated with high accuracy by feeding back an error between an actual observation value and an observation value obtained from an observation model set in advance and by correcting the state quantity. In the extended Kalman filter, a state equation and an observation equation are Taylor-expanded and linearly approximated for application to nonlinear systems.

In the third embodiment, the extended Kalman filter is set as follows. Under a condition that the sheet Q has a thickness of μ and that the sheet roll Q0 rotates 2π, the roll diameter r changes by the thickness μ. A relationship between the roll diameter r and a rotation amount θ of the sheet roll Q0 is expressed by the following equation.

$$\frac{dr}{d\theta} = -\frac{\mu}{2\pi}$$

The rotation amount θ of the sheet roll Q0 can be observed through the rotary encoder 65 and the measurement circuit 67. A time differential dr/dt of the roll diameter r can be expressed by the following equation by using an angular velocity ω of the sheet roll Q0.

$$\frac{d}{dt}r = \dot{r} = \frac{dr}{d\theta}\cdot\frac{d\theta}{dt} = \frac{dr}{d\theta}\omega = -\frac{\mu}{2\pi}\omega$$

A state quantity x related to the rotation system of the sheet roll Q0 is defined as follows by using the roll diameter r, the rotation amount θ of the sheet roll Q0, and a rotation velocity ω of the sheet roll Q0 (i.e., angular velocity ω). A superscript T is a transposition symbol.

$$x=[r\theta\omega]^T$$

On the assumption that the roll diameter r is estimated by using the extended Kalman filter during conveyance of the sheet Q at constant velocity, a time evolution model (time development model) of the state quantity x (i.e., state equation) is defined by the following equations.

$$\dot{x} = f(x)$$

$$\dot{r} = -\frac{\mu}{2\pi}\omega,\ \dot{\theta} = \omega,\ \dot{\omega} = 0$$

A Jacobian matrix A of the multivariable vector-valued function f is defined by the following equation.

$$A = \frac{\partial f}{\partial x} = \begin{bmatrix} 0 & 0 & -\frac{\mu}{2\pi} \\ 0 & 0 & 1 \\ 0 & 0 & 0 \end{bmatrix}$$

A relationship between the conveyance amount L of the sheet Q and the rotation amount θ of the sheet roll Q0 and a relationship between a conveyance velocity V of the sheet Q and the rotation velocity ω of the sheet roll Q0 are expressed as follows.

$$L=r\theta-M$$

$$V=r\omega-\zeta$$

The above relational expression related to the conveyance amount L of the sheet Q is an approximate expression because the roll diameter r changes with time. A parameter M corresponds to the change amount δD of the conveyance route length D of the sheet Q from the point P1 to the point P2 depicted in FIG. 1. A parameter ζ corresponds to a time differential of the change amount δD as well as a difference between the conveyance velocity V of the sheet Q and a circumferential velocity r·ω of the sheet roll Q0 caused by the change in the conveyance route length D. Thus, as explained in the first embodiment, the parameter M and the parameter ζ can be specified from the position X of the tensioner 15 detected by the position detector 80.

Here, an observation amount y is defined by using the conveyance amount L of the sheet Q, the conveyance velocity V of the sheet Q, and the rotation amount θ of the sheet roll Q0.

$$y=[LV\theta]^T$$

An observation model related to the observation amount y (i.e., observation equation) is defined by the following equation. In the following equation, carets or hats mean estimated values.

$$y=h(x)$$

$$\hat{L}=r\theta-M,\hat{V}=r\omega-\zeta,\hat{\theta}=\theta$$

A Jacobian matrix C of the multivariable vector-valued function h is defined by the following equation.

$$C = \begin{bmatrix} \theta & r & 0 \\ \omega & 0 & r \\ 0 & 1 & 0 \end{bmatrix}$$

In this embodiment, the roll diameter r is estimated by estimating the state quantity x by use of the extended Kalman filter based on the above state equation and the observation equation. In the estimation based on the extended Kalman filter, the state quantity x is estimated by repeating a prediction step and a filtering step.

In the prediction step, a prior estimated value $x_t$ (caret or hat) and a prior error covariance matrix $P_t$ of the state quantity x are calculated by the following equations based on a posterior estimated value x (caret or hat) certain time before, an error covariance matrix P certain time before, and a state quantity noise Q given in advance. The following equation includes the Jacobian matrix A.

$$\hat{x}_t=A\ddot{x}$$

$$P_t=APA^T+Q$$

In the filtering step, an estimated value $x_{t+1}$ (caret or hat) and an error covariance matrix $P_{t+1}$ of the state quantity x are calculated based on the prior estimated value $x_t$ (caret or hat) and the prior error covariance matrix $P_t$ of the state quantity x calculated in the prediction step, an observation amount noise R given in advance, the actual observation amount y, and a prior estimated value y (caret or hat) of the observation amount y. The following equation includes a Jacobian matrix C.

$$\hat{x}_{t+1}=\hat{x}_t+K(y-\hat{y})$$

$$P_{t+1}=(1-KC)P_t$$

$$K=P_tC^T(R+CP_tC^T)^{-1}$$

The prior estimated value y (caret or hat) of the observation amount y is calculated by the observation equation and the prior estimated value $x_t$ (caret or hat) of the state quantity x. The parameter M and the parameter ζ are calculated based on the change amount in the position X of the tensioner 15 observed.

The roll dimeter r estimated by the roll diameter estimator 150 in this embodiment is an estimated value of the roll diameter r included in an estimated value of the state quantity x calculated here. The conveyance velocity V of the sheet Q included in the observation amount y may be a conveyance velocity $R_P \cdot \omega_{PF}$ measured based on the rotation velocity $\omega_{PF}$ of the conveyance roller 20 measured by the measurement circuit 77 and the radius $R_P$ of the conveyance roller 20. Or, the conveyance velocity V of the sheet Q included in the observation amount y may be a target conveyance velocity $R_P \cdot \omega_r$ of the sheet Q based on the target rotation velocity $\omega_r$ from the velocity instruction device 101. The conveyance amount L of the sheet Q may be a measured value or a value calculated as a time differential of a conveyance velocity $V=R_P \cdot \omega_r$ based on the target rotation velocity $\omega_r$.

The state quantity x may be estimated by defining an observation equation h(x) without including the parameter ζ, that is, on the assumption that the parameter ζ is zero. The state quantity x may be estimated by defining the observation equation h(x) on the assumption that the parameter M is zero and the parameter ζ is zero.

Figure 13:
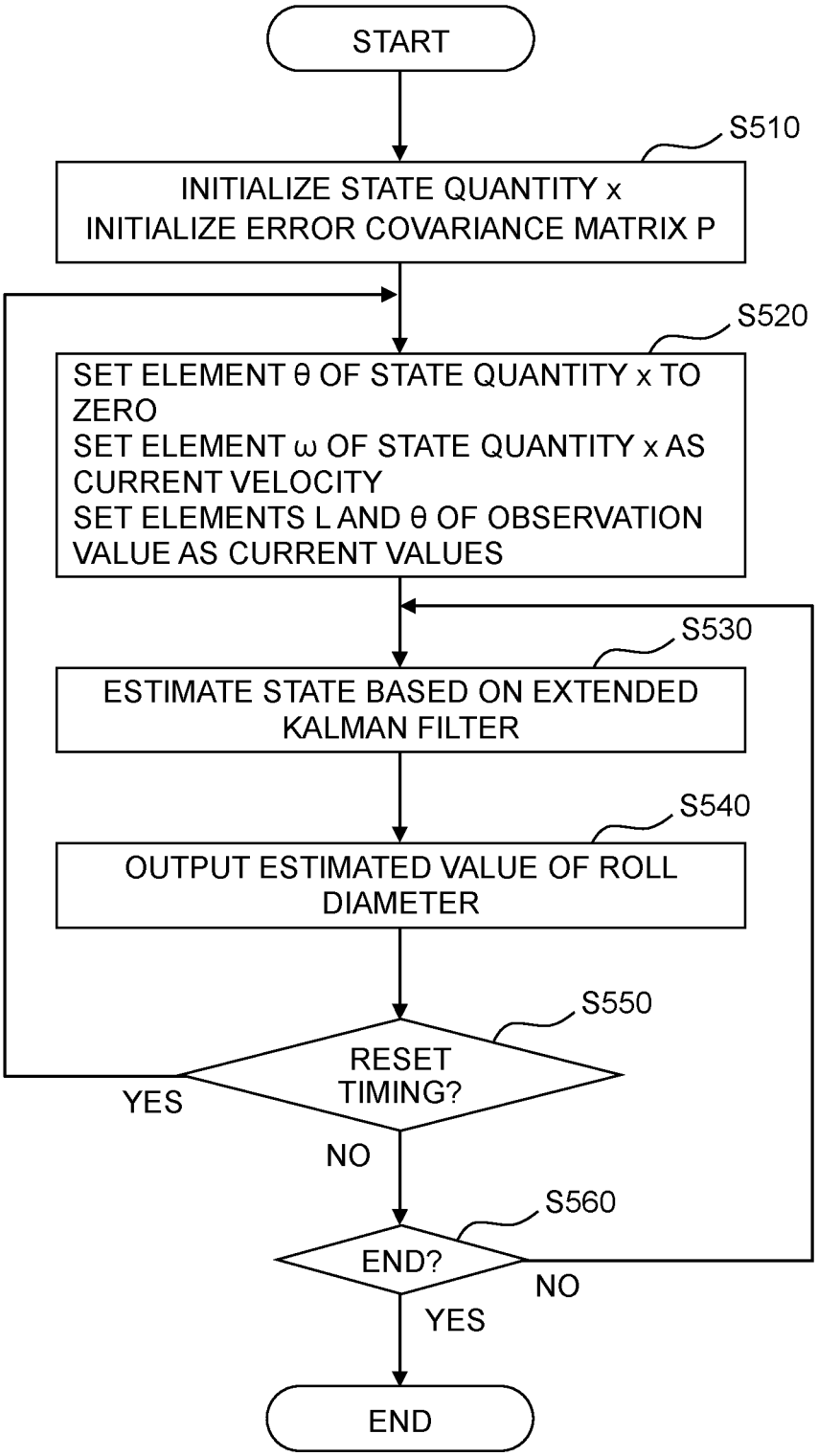
FIG. 13 is a flowchart of a process executed by the roll diameter estimator in the third embodiment.

The roll diameter estimator 150 executes the processes indicated in FIG. 13. The roll diameter estimator 150 can estimate the roll estimator r by executing the prediction step and the filtering step for each sampling period $t_s$ and updating the state quantity x.

An equation $L=r\theta-M$ related to the conveyance amount L of the sheet Q holds only approximately because the roll diameter r varies. The roll diameter estimator 150 sectionally applies the extended Kalman filter to such an equation that holds approximately, and estimates the roll diameter r.

Under a condition that the processes in FIG. 13 are started, the roll diameter estimator 150 initializes the state quantity x and the error covariance matrix P (S510). After that, the roll diameter estimator 150 sets the rotation amount θ of the sheet roll Q0 that is an element of the estate quantity x to zero. Further, the roll diameter estimator 150 sets the rotation velocity ω of the sheet roll Q0 that is an element of the state quantity x to a rotation velocity $\omega=(R_p/r)\cdot\omega_r$ corresponding to the target rotation velocity $\omega_r$ of the conveyance roller 20 based on the radius $R_p$ of the conveyance roller 20 and the estimated value of the roll diameter r. Further, the roll diameter estimator 150 sets, as current observation values, the conveyance amount L of the sheet Q and the rotation amount θ of the sheet roll Q0 that are elements of the observation amount y (S520).

After completion of the process of S520, the roll diameter estimator 150 executes the prediction step and the filtering step based on the extended Kalman filter, and calculates the estimated value of the state quantity x (S530). In the filtering step, the roll diameter estimator 150 obtains the current observation amount y measured. After that, the roll diameter estimator 150 outputs the estimated value of the roll diameter r in the state quantity x (S540).

The roll diameter estimator 150 executes the processes of S530 to S540, updates the state quantity x, and outputs the estimated value of the roll diameter r for each sampling period $t_s$ until a reset timing of the state quantity x arrives (S550: YES), or until the end conditions for the processes in FIG. 13 are satisfied (S560: Yes).

Under a condition that the reset timing has arrived (S550: Yes), the roll diameter estimator 150 executes the process of S520 to once reset a calculation result based on the extended Kalman filter before the reset timing. After executing the process of S520, the roll diameter estimator 150 executes, in S530, the prediction step and the filtering step based on the value updated in S520, and calculates the estimated value of the state quantity x.

The roll diameter estimator 150 sectionally estimates the state quantity x based on the extended Kalman filter by repeatedly executing the above processes. Under a condition that the roll diameter estimator 150 has determined that the end conditions are satisfied (S560: Yes), the roll diameter estimator 150 ends the processes in FIG. 13.

Specifically, the reset timing may be a timing at which the conveyance length L of the sheet Q corresponding to the rotation amount of the conveyance roller 20 exceeds an initial value by a predefined amount. The roll diameter estimator 150 thus calculates the estimated value of the state quantity x including the roll diameter r for each conveyance of the sheet Q by the predefined amount by use of the extended Kalman filter sectionalized.

Figure 14:
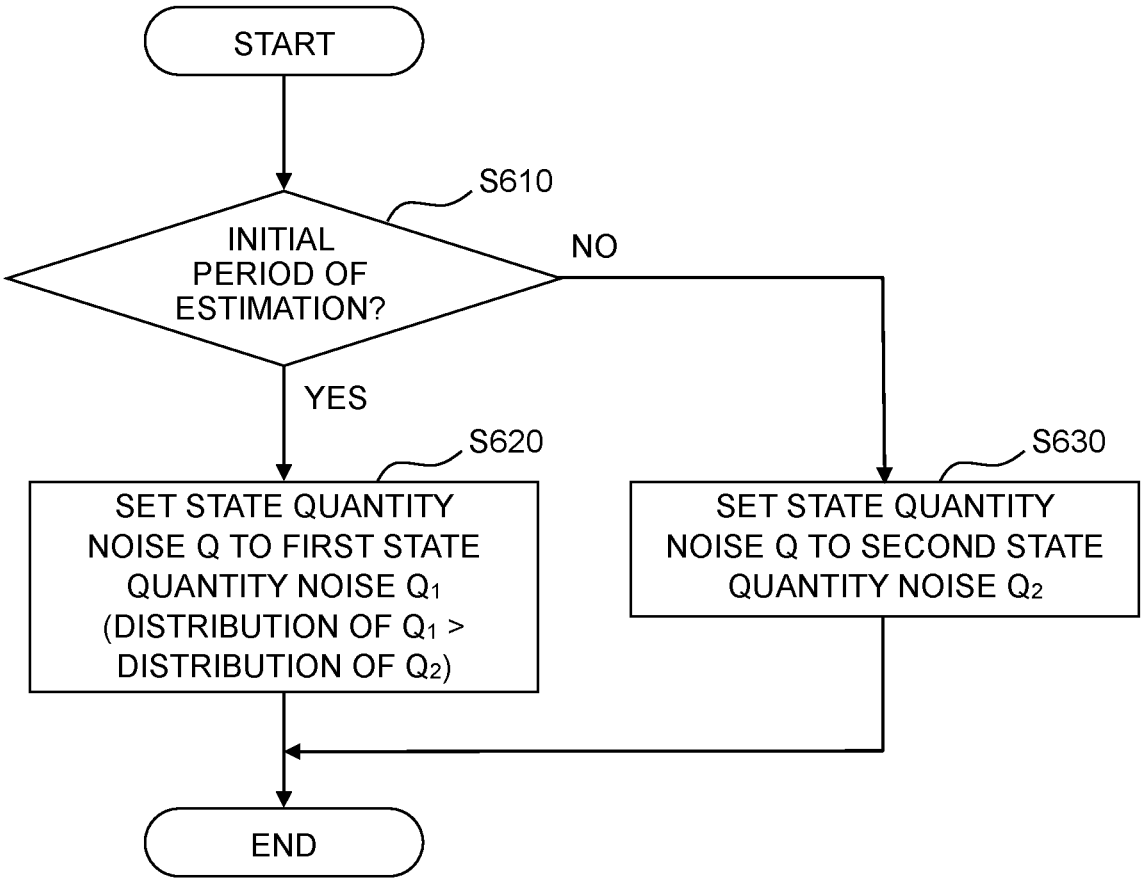
FIG. 14 is a flowchart of a switching process of state quantity noise executed by the roll diameter estimator in the third embodiment.

The roll diameter estimator 150 can estimate the state quantity x based on the extended Kalman filter by switching a setting value of the state quantity noise Q in S530 as indicated in FIG. 14.

In FIG. 14, the roll diameter estimator 150 sets the state quantity noise Q to the first state quantity noise $Q_1$ (S620) at the beginning of the estimation of the roll diameter r (S610: Yes). In any other period than the above (S610: No), the roll diameter estimator 150 sets the state quantity noise Q to the second state quantity noise $Q_2$ (S630).

The state quantity noise Q contains an element expressing variation in the state quantity x (in particular, distribution). At the beginning of the estimation of the roll diameter r, the likelihood (the degree of certainty) of the roll diameter r is low. The first state quantity noise $Q_1$ is thus defined in advance to express larger distribution than the second state quantity noise $Q_2$.

Accordingly, the roll diameter estimator 150 appropriately estimates the roll diameter r by switching the setting value of the state amount noise Q between the first state quantity noise $Q_1$ and the second state quantity noise $Q_2$ depending on the degree of certainty of the roll diameter r estimated. An initial period of the estimation of the roll diameter r, in other words, the first period from the start of estimation of the roll diameter r may be a period during which the estimated value of the roll diameter r is stabilized after the sheet roll Q0 is installed in the holder 10.

Further, the roll diameter estimator 150 may configure the extended Kalman filter by including the rotation torque τ acting on the sheet roll Q0 from the supply motor 61 and the tension T of the sheet Q. For example, a state equation may be defined as follows.

$$\dot{x} = f(x, u)$$

$$\dot{r} = -\frac{\mu}{2\pi}\omega,\ \dot{\theta} = \omega,\ \dot{\omega} = g_1(r)\omega + g_2(r)\tau + g_3(r)T$$

The roll diameter estimator 150 may estimate the state quantity x from the extended Kalman filter based on this state equation and the observation equation described above to estimate the roll diameter r.

Figure 15:
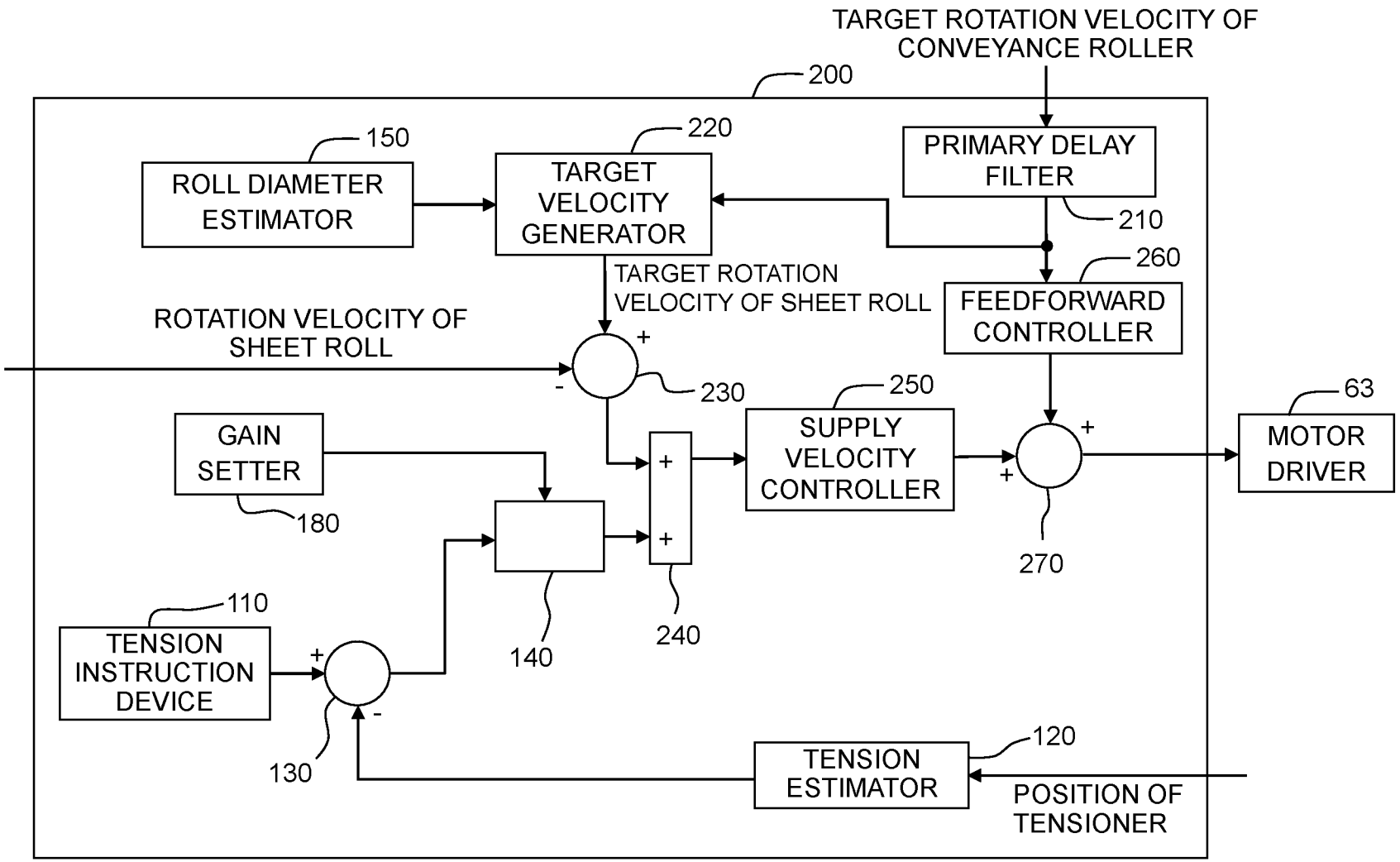
FIG. 15 is a block diagram of a configuration of the tension controller in the third embodiment.

The estimation of the roll diameter r of the sheet Q based on the extended Kalman filter described above is especially significant under a condition that the image forming system 1 includes a tension controller 200 having a configuration depicted in FIG. 15 instead of the tension controller 57.

As depicted in FIG. 15, the tension controller 200 that replaces the tension controller 57 includes the tension instruction device 110, the tension estimator 120, the deviation calculator 130, the PID controller 140, the roll diameter estimator 150, the gain setter (gain setting device) 180, a primary delay filter 210, a target velocity generator 220, a deviation calculator 230, an adder 240, a supply velocity controller 250, a feedforward controller 260, and an adder 270.

The deviation calculator 130 calculates a deviation $E_T=T_r-T$ between the target tension $T_r$ from the tension instruction device 110 and the estimated tension T from the tension estimator 120 similar to the first embodiment. The PID controller 140 calculates a tension control input $U_T=K_p \cdot E_T+K_i \cdot INT(E_T)+K_d \cdot DIF(E_T)$ based on the deviation $E_T$ input from the deviation calculator 130.

The tension control input $U_T$ corresponds to the feedback control input $U_B$ of the first embodiment. The gain setter 180 is configured to adjust the gains $K_p$, $K_i$, and $K_d$ in the PID controller 140 based on the roll diameter r estimated by the roll diameter estimator 150.

The target velocity generator 220 calculates a target rotation velocity $\omega_{sr}$ of the sheet roll Q0 based on the target rotation velocity $\omega_r$ of the conveyance roller 20 input from the velocity instruction device 101 of the velocity controller 55 via the primary delay filter 210 and the roll diameter r estimated by the roll diameter estimator 150.

The target velocity generator 220 calculates the target rotation velocity $\omega_{sr}$ in accordance with an equation $\omega_{sr}=(R_p/r)\cdot\omega_r$ so that the conveyance roller 20 and the sheet roll Q0 rotate at the same circumferential velocity. $R_p$ is a radius of the conveyance roller 20 as described above. The target rotation velocity $\omega_{sr}$ of the sheet roll Q0 corresponds to the target rotation velocity $\omega_{sr}$ of the rotation shaft 10A.

The deviation calculator 230 calculates a deviation $E_W=(\omega_{sr}-\omega)$ between the target rotation velocity $\omega_{sr}$ from the target velocity generator 220 and the rotation velocity ω of the sheet roll Q0 measured by the measurement circuit 67.

The adder 240 calculates a control input $U_C=(U_T+E_W)$ by adding the deviation $E_W$ to the tension control input $U_T$ from the PID controller 140. The supply velocity controller 250 is configured as the PID controller to calculate a feedback control input $U_B$* by adding a velocity control component to the control input $U_C$ from the adder 240. Instead of the feedback control input $U_B$ in the first embodiment, the feedback control input $U_B$* is input to the adder 270 in this embodiment.

Specifically, the supply velocity controller 250 outputs a value $U_B^*=K_{wp} \cdot U_C+K_{wi} \cdot INT(U_C)+K_{wd} \cdot DIF(U_C)$ as the feedback control input $U_B$*. $DIF(U_C)$ is a differential value of the control input $U_C$. The value $INT(U_C)$ is an integral value of the control input $U_C$. $K_{wp}$ is a proportional gain. $K_{wi}$ is an integral gain. $K_{wd}$ is a differential gain.

Instead of the actual rotation velocity $\omega_{PF}$ of the conveyance roller 20, the feedforward controller 260 calculates the acceleration torque τ similar to the first embodiment by use of the target rotation velocity $\omega_r$ of the conveyance roller 20 input from the velocity instruction device 101 of the velocity controller 55 via the primary delay filter 210.

The feedforward controller 260 inputs the feedforward control input $U_F$ corresponding to the calculated acceleration torque τ to the adder 270 similar to the first embodiment. Or, the feedforward controller 260 inputs, to the adder 270, a feedforward input $U_F$* obtained by adding a compensation amount for a viscous friction torque and a dynamic friction torque to the feedforward input $U_F$.

The adder 270 outputs an addition value $U_B^*+U_F$ obtained by adding the feedback control input $U_B$* input from the supply velocity controller 250 and the feedforward control input $U_F$ input from the feedforward controller 260 or an addition value $U_B^*+U_F^*$ obtained by adding the feedback control input $U_B$* input from the supply velocity controller 250 and the feedforward control input $U_F$*, as the control input $U_{SR}$ for the supply motor 61.

The reason why the tension controller 200 does not use the actual rotation velocity ω of the conveyance roller 20 but uses the target rotation velocity $\omega_r$ is as follows. A power transmission system such as a gear is provided between the supply motor 61 and the rotation shaft 10A of the holder 10. Thus, there is a time lag until driving of the supply motor 61 is reflected in the rotary motion of the sheet roll Q0. The time lag may cause a control error if the feedforward control input $U_F$ is calculated based on the actual rotation velocity $\omega_{PF}$ of the conveyance roller 20 to control the supply motor 61.

In the third embodiment, the feedforward control input $U_F$ or the feedforward control input $U_F$* is calculated based on the target rotation velocity $\omega_r$ of the control roller 20. In this case, the rotary motion of the sheet roll Q0 can be controlled by controlling the supply motor 61 while inhibiting the effect of the time lug.

Under the condition that the target rotation velocity $\omega_r$ is used, a tensioning process, in which the tension of the sheet Q is set to the target tension $T_r$ by reversely rotating the supply motor 61 in a state where conveyance roller 20 is stopped, may be executed similarly to the process of S430 in order to make the tension of the sheet Q the target tension $T_r$ before starting the conveyance process of the sheet Q.

In the third embodiment, since the roll diameter r is estimated by using the extended Kalman filter, it is possible to estimate the roll diameter with high accuracy while inhibiting effects of an observation error, a signal noise, and the like. Under the condition that the velocity control is performed based on the estimated value of the roll diameter r as depicted in FIG. 15, the velocity control is affected by an estimation error of the roll diameter r. Thus, estimating the roll diameter r with high accuracy improves the conveyance control of the sheet Q.

It is needless to say that the present disclosure is not limited to the above exemplary embodiments and can take various aspects. In the first embodiment, the acceleration torque τ may be estimated based on the target rotation velocity $\omega_r$ of the conveyance roller 20 and the feedforward control input $U_F$ may be calculated similarly to the third embodiment. The conveyance amount L of the sheet Q may be calculated based on an integral value of the target rotation velocity $\omega_r$.

The holding structure of the sheet roll Q0 by the holder 10 and the driving system of the sheet roll Q0 are not limited to the above embodiments. In each of the image forming systems 1 described above, the sheet roll Q0 is rotatably supported by the rotation shaft 10A of the holder 10 by inserting the core material of the sheet roll Q0 into the rotation shaft 10A of the holder 10.

However, the holder may be formed from a hollow cylindrical material of which inside has an accommodation space for the sheet roll Q0. The holder may be configured so that an inner surface defining the accommodation space for the sheet roll Q0 rotates. The sheet roll Q0 may rotate depending on the rotation of the inner surface of the holder in a state of being accommodated in the holder. Further, a roller brought into contact with an outer circumferential surface of the sheet roll Q0 may be provided. The sheet roll Q0 may rotate by rotation of this roller.

The holder 10 may have no shaft. In this configuration, a roller may be provided between the tensioner 15 and the sheet roll Q0. The rotation amount of the sheet roll Q may be measured from a rotation amount of the roller.

The technique of the present disclosure may be applied to an image forming system not including the belt mechanism 30. In this case, the image forming system may include a platen for supporting the sheet Q, instead of the belt mechanism 30. The technique of the present disclosure may be applied to an image forming system in which a recording head of a serial driving system is provided as the recording head 40 instead of the line head. In this case, the recording head forms an image on the sheet Q by reciprocatingly moving in the line direction. The technique of the present disclosure may be applied to an image forming system of an electrophotographic system.

The technique of the present disclosure may be applied to a system for forming an image on a surface of the sheet Q that faces the outside in a radial direction of the sheet roll Q0. Or, the technique of the present disclosure may be applied to a system for forming an image on a back surface of the sheet Q that faces the inside in the radial direction of the sheet roll Q0. The technique of the present disclosure may be applied to a system for forming an image on both surfaces of the sheet Q. The position of the conveyance roller 20 and the position of the nip roller 25 may be exchangeable or replaceable.

The technique of the present disclosure can be applied not only to the system for forming an image on the sheet Q by use of a color material but also to a variety of systems. For example, the technique of the present disclosure may be applied to a system for making a mark in the sheet Q through perforation or to a system for irradiating a surface of the sheet Q with light to sterilize the surface. The technique of the present disclosure may be applied to a system for forming a trace pattern on a sheet-like substrate. The sheet roll Q and the sheet Q may be paper, vinyl, or a flexible print substrate (FPC).

The configuration of the tensioner 15 is not limited to the above embodiment. The tensioner may be configured as an arm in which the first end is supported pivotally and the second end has a roller, like a pendulum arm. Further, the technique of the present disclosure does not limit the configuration of the rotary encoders 65 and 75. The rotary encoders 65 and 75 may be magnetic rotary encoders instead of optical rotary encoders.

The printing controller 53, the velocity controller 55, and the tension controller 57 may be configured by combining the CPU and the ASIC. In each of the controller 50, the main controller 51, the printing controller 53, the velocity controller 55, and the tension controller 57, the number of the CPU(s) and the ASIC(s) and whether or not the CPU and the ASIC is provided therein is not limited to the above specific examples.

The function provided in one component in each of the above exemplary embodiments may be distributed in components. The function provided in components may be integrated in one component. Part of the configuration according to each of the above exemplary embodiments may be omitted. The embodiments of the present disclosure include various embodiments or aspects that are included in the technical ideas specified by the following claims.

There is a correspondence relationship between the words and terms as follows. The process of S240 executed by the rotary encoder 65, the measurement circuit 67, and the roll diameter estimator 150 corresponds to an exemplary process achieved by a rotation measuring device. The process of S230 executed by the rotary encoder 75, the measurement circuit 77, and the roll diameter estimator 150 corresponds to an exemplary process achieved by a conveyance measuring device. The conveyance motor 71 corresponds to an exemplary first motor. The supply motor 61 corresponds to an exemplary second motor.

The deviation calculator 103 and the PID controller 105 of the velocity controller 55 correspond to an exemplary first feedback control element. The deviation calculator 130 and the PID controller 140 of the tension controller 57 correspond to an exemplary second feedback control element. The feedforward controller 160 corresponds to an exemplary feedforward control element.

What is claimed is:

1. A sheet conveyor comprising:

a holder configured to detachably hold a sheet roll;

a rotation measuring device configured to measure a rotation amount of the sheet roll;

a conveyance roller configured to convey a sheet pulled out from the sheet roll held by the holder;

a tensioner provided between the holder and the conveyance roller and configured to contact with the sheet pulled out from the sheet roll toward the conveyance roller;

a position detector configured to detect a position of the tensioner;

a motor configured to generate driving force for rotating the conveyance roller; and a controller configured to control the motor, wherein the controller is configured to estimate a diameter of the sheet roll based on a conveyance amount of the sheet caused by rotation of the conveyance roller driven by the motor, the rotation amount of the sheet roll measured by the rotation measuring device, and the position of the tensioner detected by the position detector.

2. The sheet conveyor according to claim 1, further comprising a conveyance measuring device configured to measure the conveyance amount of the sheet caused by the rotation of the conveyance roller, wherein the controller is configured to estimate the diameter of the sheet roll based on the conveyance amount of the sheet measured by the conveyance measuring device, the rotation amount of the sheet roll measured by the rotation measuring device, and the position of the tensioner detected by the position detector.

3. The sheet conveyor according to claim 1, wherein the controller is configured to:

control the motor to convey the sheet at a target conveyance velocity set in advance; and estimate the diameter of the sheet roll based on the conveyance amount of the sheet corresponding to the target conveyance velocity, the rotation amount of the sheet roll measured by the rotation measuring device, and the position of the tensioner detected by the position detector.

4. The sheet conveyor according to claim 1, further comprising a nip roller configured to nip the sheet together with the conveyance roller, wherein the controller is further configured to estimate, based on the position of the tensioner, a change amount of a conveyance route length of the sheet from a first point at which the sheet is pulled out from the sheet roll to a second point at which the sheet is nipped by the conveyance roller and the nip roller, and the controller is configured to estimate the diameter of the sheet roll based on:

a pulled-out amount of the sheet from the sheet roll that is determined from the conveyance amount of the sheet caused by the rotation of the conveyance roller and the change amount of the conveyance route length; and the rotation amount of the sheet roll.

5. The sheet conveyor according to claim 4, wherein the controller is configured to estimate the diameter R of the sheet roll, based on the conveyance amount L of the sheet caused by the rotation of the conveyance roller in a period corresponding to an estimated time, the rotation amount $\delta\theta$ of the sheet roll in the period, and the change amount $\delta D$ of the conveyance route length in the period, in accordance with a relational expression $R=(L+\delta D)/\delta\theta$.

6. The sheet conveyor according to claim 5, wherein the controller is configured to calculate the change amount $\delta D$ of the conveyance route length in the period, in accordance with an expression or a table indicating a relationship between the position X of the tensioner and the conveyance route length D of the sheet, and the change amount $\delta D$ of the conveyance route length in the period is calculated as a difference $D(X(t))-D(X(t_0))$ between a conveyance route length $D(X(t_0))$ determined from a position $X(t_0)$ of the tensioner at a starting time to in the period and a conveyance route length $D(X(t))$ determined from a position $X(t)$ of the tensioner at an ending time tin the period.

7. The sheet conveyor according to claim 5, wherein the controller is configured to repeatedly estimate the diameter R of the sheet roll, a starting time and an ending time in the period are updated depending on change of the estimated time to include a time zone that overlaps with a period corresponding to an estimated time that is estimated last time (estimated most recently), and the controller is configured to estimate the diameter R of the sheet roll based on the conveyance amount L, the rotation amount $\delta\theta$, and the change amount $\delta D$ in the period including the time zone that overlaps with the period corresponding to the estimated time that is estimated last time.

8. The sheet conveyor according to claim 1, further comprising:

a first motor, as the motor, configured to rotate the conveyance roller; and a second motor configured to rotate the sheet roll held by the holder, wherein the controller is configured to further control the second motor.

9. The sheet conveyor according to claim 8, wherein the controller is configured to:

repeatedly estimate the diameter of the sheet roll;

store the diameter of the sheet roll estimated as an estimated value;

control the first motor and the second motor through a first control under a condition that a predefined condition is satisfied;

control the first motor and the second motor through a second control under a condition that the predefined condition is not satisfied;

in the first control, control the second motor so that tension of the sheet is controlled based on the estimated value, and control the first motor so that the sheet is conveyed at a first velocity; and in the second control, control the second motor so that the tension of the sheet is controlled without using the estimated value, and control the first motor so that the sheet is conveyed at a second velocity lower than the first velocity.

10. The sheet conveyor according to claim 9, wherein the controller is configured to determine, in the first control, a control input for the first motor and a control input for the second motor by using a first feedback control element, a second feedback control element, and a feedforward control element, the first feedback control element is configured to calculate a first control input for the first motor based on an observation value related to rotary motion of the conveyance roller and a target value thereof, the second feedback control element is configured to calculate a second control input for the second motor based on a position of the tensioner observed and a target tension, the feedforward control element is configured to calculate a correction amount for the second control input based on the estimated value, and the controller is configured to determine, in the second control, a control input for the first motor and a control input for the second motor not using the feedforward control element but using the first feedback control element and the second feedback control element.

11. The sheet conveyor according to claim 9, further comprising:

a nip roller configured to nip the sheet together with the conveyance roller, and a process unit configured to execute a predefined process for the sheet, wherein the conveyance roller is configured to convey the sheet in a conveyance direction, the process unit is provided downstream of the conveyance roller in the conveyance direction, and in the second control, the controller is configured to control the first motor such that the sheet is conveyed at the second velocity lower than the first velocity in a process in which the sheet nipped by the conveyance roller and the nip roller is conveyed to a position facing the process unit.

12. The sheet conveyor according to claim 8, wherein the controller is configured to:

repeatedly estimate the diameter of the sheet roll;

store the diameter of the sheet roll estimated as an estimated value;

determine whether or not the estimated value stored is accurate;

control the first motor and the second motor through a first control under a condition that accuracy of the estimated value is high;

control the first motor and the second motor through a second control under a condition that the accuracy of the estimated value is low;

in the first control, control the second motor so that tension of the sheet is controlled based on the estimated value, and control the first motor so that the sheet is conveyed at a first velocity; and in the second control, control the second motor so that the tension of the sheet is controlled without using the estimated value, and control the first motor so that the sheet is conveyed at a second velocity lower than the first velocity.

13. The sheet conveyor according to claim 8, wherein before the sheet is conveyed by the rotation of the conveyance roller, the controller is configured to:

control the second motor such that the sheet is fed from the sheet roll by a predefined amount;

set the position detector such that the position detector detects the position of the tensioner as a relative position from an origin position, the origin position being a position of the tensioner under a condition that the sheet is fed by the predefined amount; and control the second motor to rewind the sheet to the sheet roll such that the position of the tensioner detected by the position detector moves from the origin position by the tension of the sheet, and the sheet flexes under a condition that the sheet is fed from the sheet roll at least by the predefined amount, and the tensioner is static at the origin position.

14. The sheet conveyor according to claim 1, wherein the controller is configured to estimate the diameter of the sheet roll by estimating a state quantity related to a rotation system of the sheet roll including the diameter of the sheet roll by use of a Kalman filter based on the conveyance amount of the sheet, the rotation amount of the sheet roll, and the position of the tensioner.

15. The sheet conveyor according to claim 14, wherein the Kalman filter is an extended Kalman filter based on a time evolution model of the state quantity that includes, as the state quantity, the diameter R of the sheet roll, the rotation amount θ of the sheet roll, and an angular velocity w of the sheet roll, the time evolution model including a thickness μ of the sheet and being represented by $$\dot{R} = -\frac{\mu}{2\pi}\omega,\ \dot{\theta} = \omega,\ \dot{\omega} = 0$$

and based on an observation model that includes the conveyance amount L of the sheet, a conveyance velocity V of the sheet, and the rotation amount 0 of the sheet roll and further includes a parameter M related to the position of the tensioner, the observation model being represented by $$\hat{L}=R\theta-M,\ \hat{V}=R\omega,\hat{\theta}=\theta$$

wherein the parameter M is a change amount of a conveyance route length of the sheet from a first point at which the sheet is pulled out from the sheet roll to a second point at which the sheet receives conveyance force from the conveyance roller, and the parameter M is calculated based on a change amount of the position of the tensioner.

16. The sheet conveyor according to claim 14, wherein the Kalman filter is an extended Kalman filter based on a time evolution model of the state quantity that includes, as the state quantity, the diameter R of the sheet roll, the rotation amount θ of the sheet roll, and an angular velocity w of the sheet roll, the time evolution model including a thickness μ of the sheet and being represented by $$\dot{R} = -\frac{\mu}{2\pi}\omega,\ \dot{\theta} = \omega,\ \dot{\omega} = 0$$

and based on an observation model that includes the conveyance amount L of the sheet, a conveyance velocity V of the sheet, and the rotation amount θ of the sheet roll and further includes a parameter M and a parameter ζ related to the position of the tensioner, the observation model being represented by $$\hat{L}=R\theta-M,\hat{V}=R\omega-\zeta,\hat{\theta}=\theta$$

wherein the parameter M is a change amount of a conveyance route length of the sheet from a first point at which the sheet is pulled out from the sheet roll to a second point at which the sheet receives conveyance force from the conveyance roller, and the parameter M is calculated based on a change amount of the position of the tensioner.

17. The sheet conveyor according to claim 14, wherein the controller is configured to estimate the state quantity by use of the Kalman filter while performing switching of a setting value of state quantity noise that defines variation in the state quantity, and the controller is configured to make the state quantity noise in a first period starting under a condition that the estimation of the diameter of the sheet roll is started, larger than the state quantity noise in a second period after the first period.

18. An image forming system comprising:

the sheet conveyor as defined in claim 1; and a process unit provided downstream of the conveyance roller in a conveyance direction of the sheet and configured to form an image on the sheet.

* * * * *